US012789962B2

(12) United States Patent
De Turckheim

(10) Patent No.: US 12,789,962 B2
(45) Date of Patent: Nov. 10, 2026

(54) ASSEMBLY COMPRISING A PROFILED SAIL; A MAST AND SEVERAL CAMBERING DEVICES FOR A PROFILED SAIL, AND A SYSTEM FOR REDUCING THE SURFACE AREA OF THE PROFILED SAIL EXPOSED TO THE WIND

(71) Applicants: Philippe Marcovich, Lamorlaye (FR); Hugues De Turckheim, Saint Andre les Alpes (FR)

(72) Inventor: Hugues De Turckheim, Saint Andre les Alpes (FR)

(73) Assignees: Philippe Marcovich, Lamorlaye (FR); Hugues De Turckheim, Saint-André-les-Alpes (FR)

( * ) Notice: Subject to any disclaimer, the term of this patent is extended or adjusted under 35 U.S.C. 154(b) by 292 days.

(21) Appl. No.: 18/694,189

(22) PCT Filed: Sep. 19, 2022

(86) PCT No.: PCT/FR2022/051760
§ 371 (c)(1),
(2) Date: Mar. 21, 2024

(87) PCT Pub. No.: WO2023/047048
PCT Pub. Date: Mar. 30, 2023

(65) Prior Publication Data

US 2025/0136257 A1 May 1, 2025

(30) Foreign Application Priority Data

Sep. 21, 2021 (FR) ..... 2109908

(51) Int. Cl.
*B63H 9/061* (2020.01)

(52) U.S. Cl.
CPC ..... *B63H 9/0628* (2020.02)

(58) Field of Classification Search
CPC ..... B63H 9/0628
See application file for complete search history.

(56) References Cited

U.S. PATENT DOCUMENTS 4,757,779 A * 7/1988 Graveline ..... B63H 9/08 114/102.26
4,796,554 A * 1/1989 Laib ..... B63C 15/00 114/90

(Continued)

FOREIGN PATENT DOCUMENTS

EP 3299275 A1 3/2018
JP 2011098669 A 5/2011

(Continued)

OTHER PUBLICATIONS

International Search Report issued on Jan. 13, 2023, in corresponding International Application No. PCT/FR2022/051760; 4 pages.

*Primary Examiner* — Jess Whittington
(74) *Attorney, Agent, or Firm* — Maier & Maier, PLLC

(57) ABSTRACT

An assembly including a profiled sail, a mast and several cambering devices for the profiled sail. The cambering devices including a semi-rigid structure, elastically deformable, including two length sections, extending in front of one another, forming respectively a first length section secured to a first surface of the profiled sail and a second length section secured to a second surface of the profiled sail, a U-shaped connecting section, interconnecting the first length section and the second length section while extending them. A system reduces the surface area of the profiled sail exposed to the wind, and configured to reduce the surface area of the profiled sail including several sections of the profiled sail as well as structural cambering devices.

17 Claims, 11 Drawing Sheets

(56) References Cited

U.S. PATENT DOCUMENTS

| | | | | |
|---|---|---|---|---|
| 6,431,100 | B2 * | 8/2002 | Abshier | B63H 9/1021 114/102.22 |
| 6,953,000 | B2 * | 10/2005 | Fink | B63H 9/1021 114/102.1 |
| 2001/0047745 | A1 * | 12/2001 | Abshier | B63H 9/061 114/102.1 |
| 2004/0069197 | A1 * | 4/2004 | Gonen | B63H 9/061 114/102.1 |
| 2011/0168073 | A1 * | 7/2011 | Waldhauser | B63H 9/1042 114/7 |
| 2024/0270362 | A1 * | 8/2024 | Essinger | B63H 9/0615 |

FOREIGN PATENT DOCUMENTS

| | | | |
|---|---|---|---|
| WO | 9104191 | A2 | 4/1991 |
| WO | 2021148734 | A1 | 7/2021 |

* cited by examiner

ASSEMBLY COMPRISING A PROFILED SAIL; A MAST AND SEVERAL CAMBERING DEVICES FOR A PROFILED SAIL, AND A SYSTEM FOR REDUCING THE SURFACE AREA OF THE PROFILED SAIL EXPOSED TO THE WIND

The present disclosure relates to an assembly comprising a profiled sail, a mast and a plurality of cambering devices for a profiled sail, and a system for reducing the surface area of the profiled sail exposed to the wind.

Such a reducing system is advantageously configured to adjust the surface area of the profiled sail in use, in particular during navigation for a sailboat, so as to adapt the useful surface area of the profiled sail to the force of the wind.

The present disclosure also relates to a method for reducing the surface area of the profiled sail exposed to the wind.

FIELD

The present disclosure relates to the field of rigging, and more particularly to profiled sails, also called "wing sails" or "thick sails", "double-skin thick sail", or "wing" by a person skilled in the art, and more particularly mechanisms, internal to the sail, allowing changing the profile of the sail.

BACKGROUND

An assembly is known from the document WO2021/148734A1 of the present Inventor comprising a profiled sail; a mast and several cambering devices for a profiled sail, the cambering devices comprising:

- a semi-rigid structure, elastically deformable, including:
  - two length sections, extending in front of one another, respectively forming a first length section secured to a first surface of the profiled sail, and a second length section secured to a second surface of the profiled sail,
  - a U-shaped connecting section, connecting together the first length section and the second length section while extending them at the leading edge of the profiled sail, the two length sections terminating at the trailing edge of the sail by two free ends.

According to the document WO 2021/148734, actuating means connect together, on the one hand, the two free ends of the semi-rigid structure, or at least one of the two free ends, and, on the other hand, the U-shaped connecting section, configured to camber the first length section and the second length section of the semi-rigid structure by tensioning the two free ends with the U-shaped connecting section of the semi-rigid structure, or at least by tensioning one of the two free ends with the U-shaped connecting section of the semi-rigid structure, and the generation of an offset between the two free ends. In such an assembly, the mast extends inside the semi-rigid structure, between the two length sections formed by the first length section and the second length section of the semi-rigid structure.

The actuating means are configured to camber the semi-rigid structure selectively:

- in a first cambered position in which said first length section has a concave profile when said second length section has a convex profile,
- in a second cambered position in which said second length section has a concave profile when said first length section has a convex profile.

The cambering devices according to WO 2021/148734 are configured to be easily movable along the mast, which allows easily hoisting the profiled sail or, on the contrary, sprawling it in a low position.

Nonetheless, the present disclosure focusses on the problem of reducing the useful surface area of the sail by folding it in order to adapt its dimensions in heavy weather. Thus, it is known to reduce the sail by folding it on the boom and according to a procedure known to a person skilled in the art as "reefing".

The teaching of WO 2021/148734 provides no information concerning a system for reducing the surface area of a sail used exposed to the wind, and configured to adapt the surface area of the sail according to the force of the wind.

According to the prior art of rigging, in particular for classic (non-profiled) mainsails, the triangular sails comprise on the upper part a head to which the halyard is attached and a tack and a clew on the lower part of the sail. When the sail is hoisted to the high position, the sail is adjusted so that the luff (the front edge between the head and the tack) and the leech (the rear edge between the head and the clew) are strained as desired depending on the wind conditions.

In order to reduce the useful surface area of the (main) sail in a high wind, the cloth of the sail is typically equipped with reefs (and in particular a first reef, a second reef, a third reef) conventionally respectively consisting of lacing holes located at different heights above the clew and the tack.

After having eased the halyard and partially lowered the sail until the reef (first reef, second reef, etc.) lies at the height of the boom; the lacing holes of the reefs are used for strain the edge of the sail. To this end, a rope so-called "reefing pendant", present in particular on the leach of a sail, can be used. Second ropes typically called "reef points" attached to the cloth of the sail, are then used to furl the surplus, unused part of the sail, to the base thereof after reefing. The reef points typically pass through the lacing holes and have enough length to hold the surplus of the sail on the boom, surrounding the boom.

Booms with drums are known from the prior art, said drum allowing automation of reefing, by winding the lower portion of the sail of a desired size, always in order to reduce the surface area of the sail in the wind.

According to the observations of the Inventor, conventional reefing systems, with lacing holes according to the prior art of triangular sails, or with a drum, are not suitable for a profiled sail of an assembly as disclosed in WO2021/148734A1.

In particular, it should be noted that the prior art with reefing lacing holes with reef points comprise ropes directly attached to the cloth of the sail, used for furling the surplus part of the sail, and which generate local stresses on the cloth of the sail, which local stresses might cause ripping off in a strong wind with tearing of the sail.

SUMMARY

The present disclosure improves the situation.

An assembly is provided comprising a profiled sail; a mast and several cambering devices for a profiled sail, all or part of the cambering devices comprising:

- a semi-rigid structure, elastically deformable, including:
  - two length sections, extending in front of one another, respectively forming a first length section secured to a first surface of the profiled sail, and a second length section secured to a second surface of the profiled sail,
  - a U-shaped connecting section, interconnecting the first length section and the second length section at the leading edge of the profiled sail while extending them, the two length sections terminating at the trailing edge of the sail by two free ends, and wherein the mast extends inside the semi-rigid structure, between the two length sections and wherein the profiled sail is configured to be:

hoisting along the mast, in a high position of the profiled sail, the cambering devices in positions spaced apart from one another, sprawled along the mast, in a low position of the profiled sail, the cambering devices in positions brought close to one another.

According to the present disclosure, said assembly comprises a system for reducing the surface area of the profiled sail exposed to the wind, configured to reduce the surface area of the profiled sail in an intermediate position along the mast between said high position of the profiled sail and the low position, comprising:

several distinct and separate sections of the profiled sail along the direction of the mast, made of flexible cloth, with at least a first section of the profiled sail and a second section of the profiled sail, several ones of the cambering devices consisting of structural cambering devices, comprising a bottom cambering device and at least one intermediate cambering device, said at least one intermediate structural cambering device ensuring the transmission of forces due to the pressure of the wind on the profiled sail between two successive separate and distinct sections of the profiled sail, with a lower edge of the first section of the profiled sail connected to an upper edge of the bottom cambering device, and an upper edge of the first section of the profiled sail connected to a lower edge of the first intermediate cambering device, a lower edge of the second section of the profiled sail connected to an upper edge of the first intermediate cambering device, so that in the high position of the profiled sail, the tensioned cloth of the first section of the profiled sail and the tensioned cloth of the second section of the profiled sail extend discontinuously along the direction of the mast, the semi-rigid structure of said first intermediate cambering device, extending the first section of the profiled sail and the second section of the profiled sail in the high position of the profiled sail ensuring the transmission of the forces between the first section of the profiled sail and the second section of the profiled sail, a removable, fastening system ensuring connection between the structural cambering devices, at least between the bottom cambering device and said first intermediate cambering device, so as to obtain a first reduction in the surface area of the profiled sail, and possibly connection between two successive intermediate cambering devices in order to obtain at least one second reduction (or more) in the surface area of the profiled sail, greater than the first reduction in the surface area, when the profiled sail is in the intermediate position between said high position of the profiled sail and the low position of the profiled sail, the structural cambering devices in positions brought close to one another in all or part, with at least the bottom cambering device and the first cambering device brought close to one another, the accumulated surplus cloth of the first section being preferably held by a link of a fastening system joining the semi-rigid structure of the bottom cambering device to the semi-rigid structure of the first intermediate cambering device.

Optionally, the features disclosed in the next paragraphs may be implemented. They may be implemented independently of one another or in combination with one another.

According to an embodiment, the fastening system may comprise hooking points projecting outwardly along the first length section of the second length section of the structural cambering devices, as well as at least one flexible link, configured to hook the hooking points of two successive cambering devices when the profiled sail is in said intermediate position with the two successive cambering devices being brought close to one another, while holding the section of the sail accumulated and connected to the two successive cambering devices. The hooking points may consist of hooks or lugs in particular with enlarged ends.

According to one embodiment, besides the structural cambering devices of the system for reducing the surface area of the profiled sail exposed to the wind, said cambering devices comprise secondary cambering devices, cooperating with different sections of the profiled sail, each in an intermediate position of the section of the profiled sail between the upper edge and the lower edge of said section of the profiled sail.

The semi-rigid structure of the intermediate structural cambering devices of the system for reducing the surface area of the profiled sail exposed to the wind may have a height dimension, along the direction of the mast, larger than the height dimension of the secondary cambering devices. The rigidity (along the direction of the mast, i.e. in particular the vertical direction) of the semi-rigid structure of the structural cambering devices is higher than the rigidity of the secondary cambering devices.

The number of distinct sections of the profiled sail is equal to an integer number N comprised between 2 and 10, such that N is equal to 5, and the number of structural cambering devices for reducing the surface area of the profiled sail exposed to the wind is equal to an integer number N.

According to one embodiment, the different sections of the profiled sail consist of cloths having different properties, in particular different materials and/or different basis weights.

According to an embodiment, said assembly comprises actuating means interconnecting, on the one hand, the two free ends of the semi-rigid structure, or at least one of the two free ends, and, on the other hand, the U-shaped connecting section, configured to camber the first length section and the second length section of the semi-rigid structure by tensioning the two free ends with the U-shaped connecting section of the semi-rigid structure, or at least by tensioning one of the two free ends with the U-shaped connecting section of the semi-rigid structure, and the generation of an offset between the two free ends.

In particular, the actuating means configured to camber the first length section and the second length section of the semi-rigid structure may comprise at least one actuator, having two longitudinal ends, said actuator, able to be activated, being retractable when activated with its two longitudinal ends being brought close to one another, said at least one actuator extending along one of the two length sections of the semi-rigid structure, the first length section or the second length section, said actuator being internal to the semi-rigid structure, contained in a plane of the semi-rigid structure, and wherein one of the longitudinal ends of said at least one actuator is connected to one of the two free ends by an internal tendon while the other one of the two longitudinal ends of said at least one actuator is connected either to an anchor point secured to the U-shaped connecting section, or to the other one of the two free ends via a deflector secured to the U-shaped connecting section by an external tendon, the flexible external tendon passing outside the semi-rigid structure, and the profiled sail between the deflector and respectively said other one of the two free ends.

The actuating means may be configured to camber the semi-rigid structure selectively:

in a first cambered position in which said first length section has a concave profile when said second length section has a convex profile, in a second cambered position in which said second length section has a concave profile when said first length section has a convex profile.

In particular, said at least one actuator of the actuating means may comprise:

a first actuator configured to camber the semi-rigid structure in said first cambered position, extending along the first length section, inside the semi-rigid structure, secured at one of its longitudinal ends to the external tendon, connected, on the one hand, to the free end of the first length section by said external tendon, flexible, which is external to the semi-rigid structure, via a first deflector secured to the connecting section, U-shaped, the flexible external tendon passing outside the semi-rigid structure, and the profiled sail between the first deflector and respectively the free end of the first length section, the flexible external tendon being internal to the semi-rigid structure between the first deflector and said first actuator, the first actuator being secured at the other one of its longitudinal ends to the internal tendon, said first actuator connected; on the other hand; to the free end of said second length section by said internal tendon, which runs along the first length section up to a guide secured to said first length section before connecting said free end of said second length section, the first actuator being configured, in an active state, to retract and pull on the two free ends connected by the external tendon and the internal tendon, on the one hand, and on the first deflector, on the other hand, until the creation of the shift, the end connected by the internal tendon advancing towards the leading edge relative to the free end connected by the external tendon while causing cambering of the semi-rigid structure, the loaded external tendon deviating from the first length section which takes on a concave profile, the second length section taking on a convex profile in said first cambered position, a second actuator configured to camber the semi-rigid structure in said second cambered position, extending along the second length section inside the semi-rigid structure, secured at one of its longitudinal ends to an external tendon, connected, on the one hand, to the free end of the second length section by the external tendon, flexible, which is external to the semi-rigid structure, via a second deflector secured to the U-shaped connecting section, the flexible external tendon passing outside the semi-rigid structure, and the profiled sail between the second deflector and respectively the free end of the second length section, the flexible external tendon being internal to the semi-rigid structure between the second deflector and said second actuator, the second actuator being secured at the other one of its longitudinal ends to the internal tendon, said second actuator connected, on the other hand, to the free end of said first length section by said internal tendon which runs along the second length section up to a guide secured to said second length section before connecting the free end of said first length section, the second actuator being configured, in an active state, to retract and pull on the two free ends connected by the external tendon and the internal tendon, on the one hand, and on the second deflector, on the other hand, until the creation of the shift, the free end connected by the internal tendon advancing towards the leading edge relative to the free end connected by the external tendon while causing cambering of the semi-rigid structure, the loaded external tendon deviating from the second length section which takes on a concave profile, while said first length section takes on a convex profile in said second cambered position.

According to one embodiment, all or part of the cambering devices have a securing system, able to be activated/deactivated, configured to ensure securing of the cambering device on the mast, the securing system comprising:

a first flexible strand connected to the first length section by two longitudinal ends of the first strand, the first strand circumventing the mast from the first length section, a second flexible strand connected to the second length section by two longitudinal ends of the second strand, the second strand circumventing the mast from the second length section, an actuator system, activatable, internal to the structure configured to pass the first strand and the second strand into a retracted state configured to block (gird) the cambering device on the mast, clasped between the first strand and the second strand, inside the semi-rigid structure, the mast held at a distance from the two length sections by the tensioned first strand and second strand, and into a deployed state of the first strand and second strand configured to release the mast; and thus enable movement of the cambering device along the mast.

According to one embodiment, the actuator system of the securing system comprises at least one actuating member having two longitudinal ends, said actuating member, able to be activated, being retractable when activated with its two longitudinal ends being brought close to one another.

According to one embodiment, the cambering devices comprise all or part of a spacer system comprising a first spacer, interconnecting the first length section and the second length section, as well as a second spacer, interconnecting the first length section and the second length section, parallel to said first spacer, on the one hand, and the second length section, on the other hand, and wherein the longitudinal ends of the first strand are secured at two attachment points on the first length section at the junction areas between the first and second spacers respectively and the first length section, the longitudinal ends of the second strand being secured at two attachment points on the second length section at the junction areas between the first and second spacers respectively. Thus, the mast extends between the spacers consisting of the first spacer and the second spacer, the first strand and the second strand clasped onto the mast ensuring holding of the mast at a distance from the first spacer, on the one hand, and of the mast from the second spacer, on the other hand.

According to one embodiment, the system for reducing the surface area of the profiled sail exposed to the wind includes a tightening device, configured to bring two structural cambering devices close to one another, in particular the bottom cambering device with the intermediate cambering devices, or configured to bring two intermediate cambering devices close to one another, the tightening device comprising:

guides such as castors, secured to the rigid structure of two structural cambering devices to be brought close to one another, the guides being arranged on an inner side of the semi-rigid structure, along the first length section and/or along the second length section at least one tightening link, extending within the profiled sail, and which runs along the guides, while being guided by the guides, the guides being arranged alternately on the two cambering devices along the pathway of the link, the link fastened at a distal end on the semi-rigid structure of one of the two cambering devices to be brought close to one another and so that the tightening device is configured so that a tension on the tightening link causes the structural cambering devices to be brought close to one another.

The present disclosure also relates to a vehicle, in particular a sailboat, comprising an assembly according to the present disclosure.

According to a second aspect, the present disclosure relates to a method for reducing the surface area of the profiled sail exposed to the wind using an assembly according to the present disclosure or belonging to a sailboat according to the present disclosure from a high position of the profiled sail on the mast, the cambering devices in positions spaced apart from one another, and wherein it is proceeded with the reduction of the surface area of the profiled sail exposed to the wind:

partially sprawling the profiled sail in an intermediate position between said high position of the profiled sail and the low position, and by bringing at least the bottom cambering device, and said first intermediate cambering device, or even two successive intermediate cambering devices, close to one another, the structural cambering devices being brought close to one another in all or part, placing the link of the fastening system between at least the bottom cambering device and the first intermediate cambering device brought close to one another, the cloth of the first section of the sail, accumulated and held at least by the link joining the semi-rigid structure of the bottom cambering device to the semi-rigid structure of the first intermediate cambering device, and possibly placing at least one additional link between the successive intermediate cambering devices, the intermediate link holding the section of the sail accumulated between said intermediate cambering devices.

BRIEF DESCRIPTION OF THE DRAWINGS

Other features, details and advantages will appear upon reading the following detailed description, and upon analysis of the appended drawings, wherein.

to the left, a high position of the profiled sail along the mast, the surface area of the profiled sail entirely deployed and exposed to the wind in the middle, a first intermediate position of the profiled sail ensuring a first reduction of the surface area of the profiled sail exposed to the wind (i.e. a "first reef") wherein the bottom cambering device and the first intermediate cambering device are brought close to one another, the first section of the accumulated profiled sail being held by a link of the fastening system connecting the bottom cambering device and the first intermediate cambering device, to the right, a second intermediate position of the profiled sail ensuring a second reduction of the surface area of the profiled sail exposed to the wind (namely, a "second reef") wherein not only the bottom cambering device and the first intermediate cambering device are brought close to one another, but also the first intermediate cambering device and the second intermediate cambering device are brought close to one another, the accumulated first section of the profiled sail being held by a (first) link of the fastening system connecting the bottom cambering device and the first intermediate cambering device, the accumulated second section of the profiled sail being held by an additional link (second link) of the fastening system connecting the first intermediate cambering device and the second intermediate cambering device.

Figure 7:
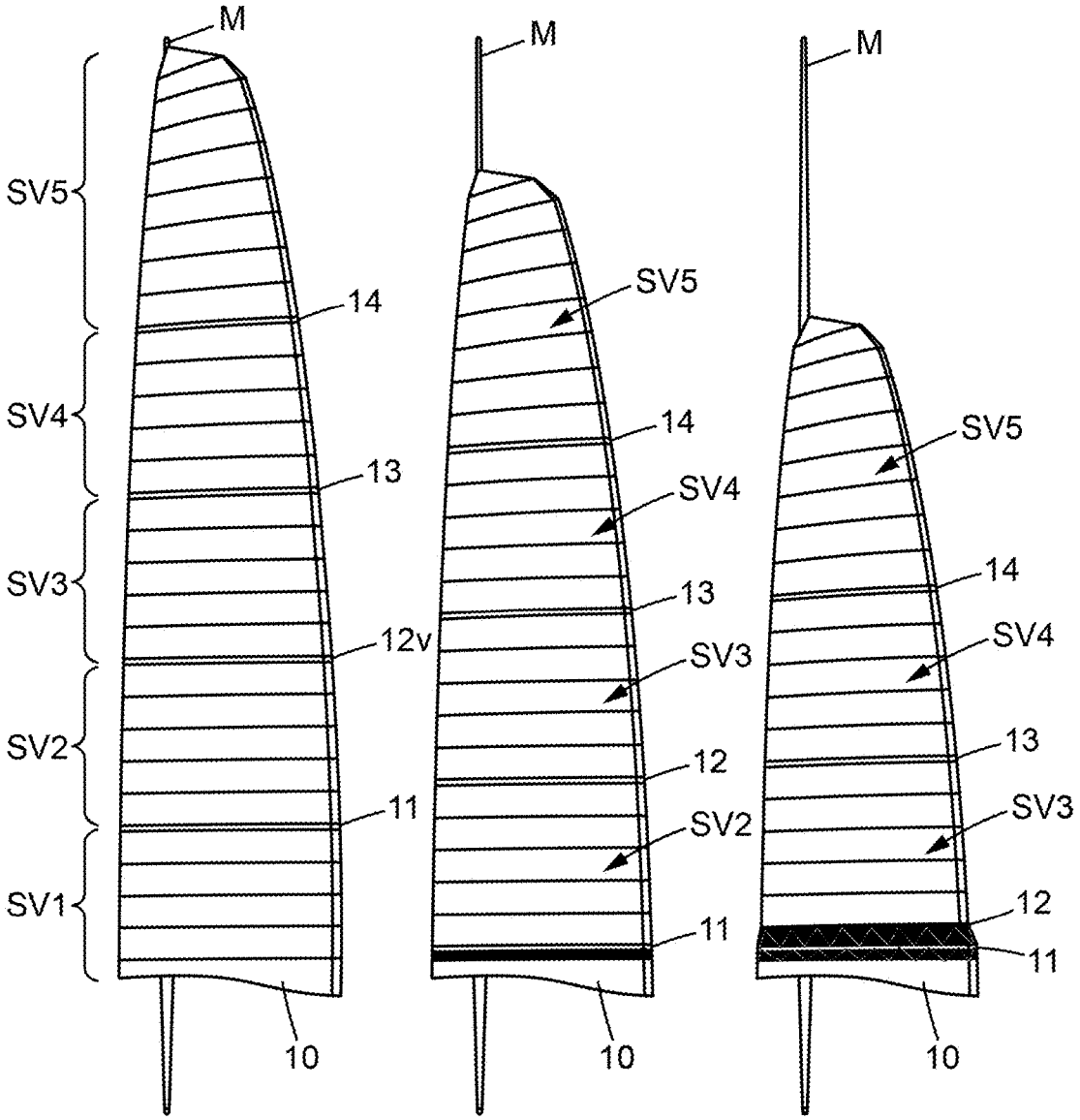
FIG. 7 illustrates three views of said assembly, with from left to right.
Figure 8:
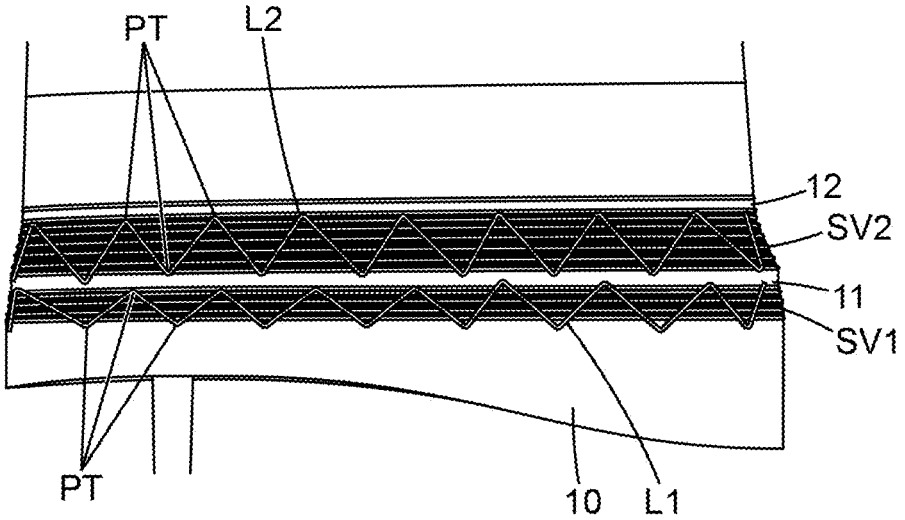

FIG. 8 is a detail view of the fastening system of FIG. 7 in the second profiled intermediate position ensuring a second reduction of the surface area of the profiled sail exposed to the wind illustrating, in particular, the links and the hooking points on the semi-rigid structures of the structural cambering devices.

Figure 9:
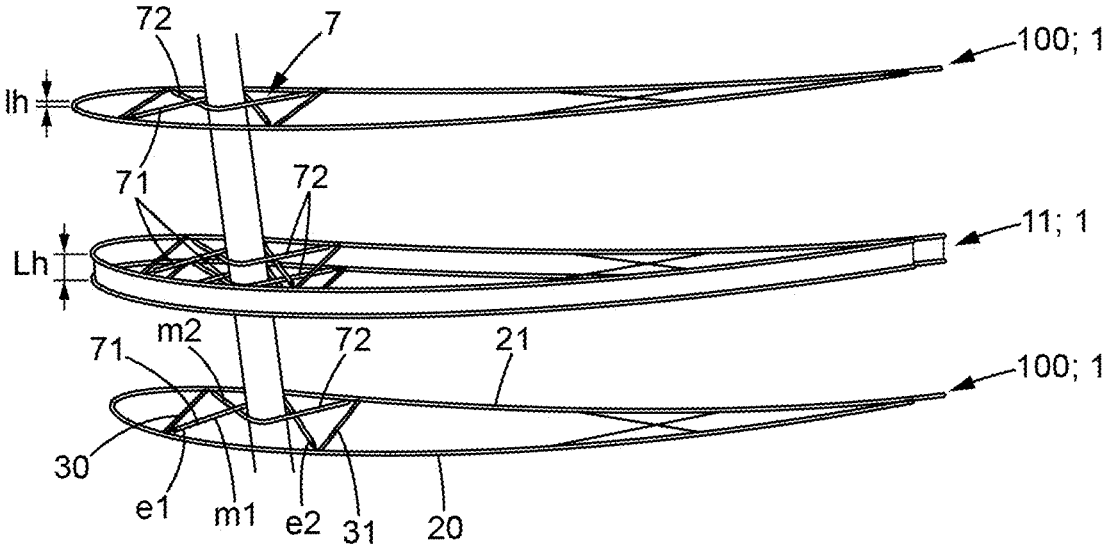

FIG. 9 is a detail view (the profiled sail not illustrated) illustrating the mast, an intermediate cambering device, and two structural secondary cambering devices, on both side of said intermediate cambering device the semi-rigid structure of which having a height dimension smaller than the height dimension of the intermediate cambering device, the cambering devices comprising a securing system, able to be activated/deactivated, configured to ensure securing of the cambering device on the mast, with a first strand and a second strand formed respectively by artificial muscles configured to gird the mast when retracted lengthwise.

Figure 10:
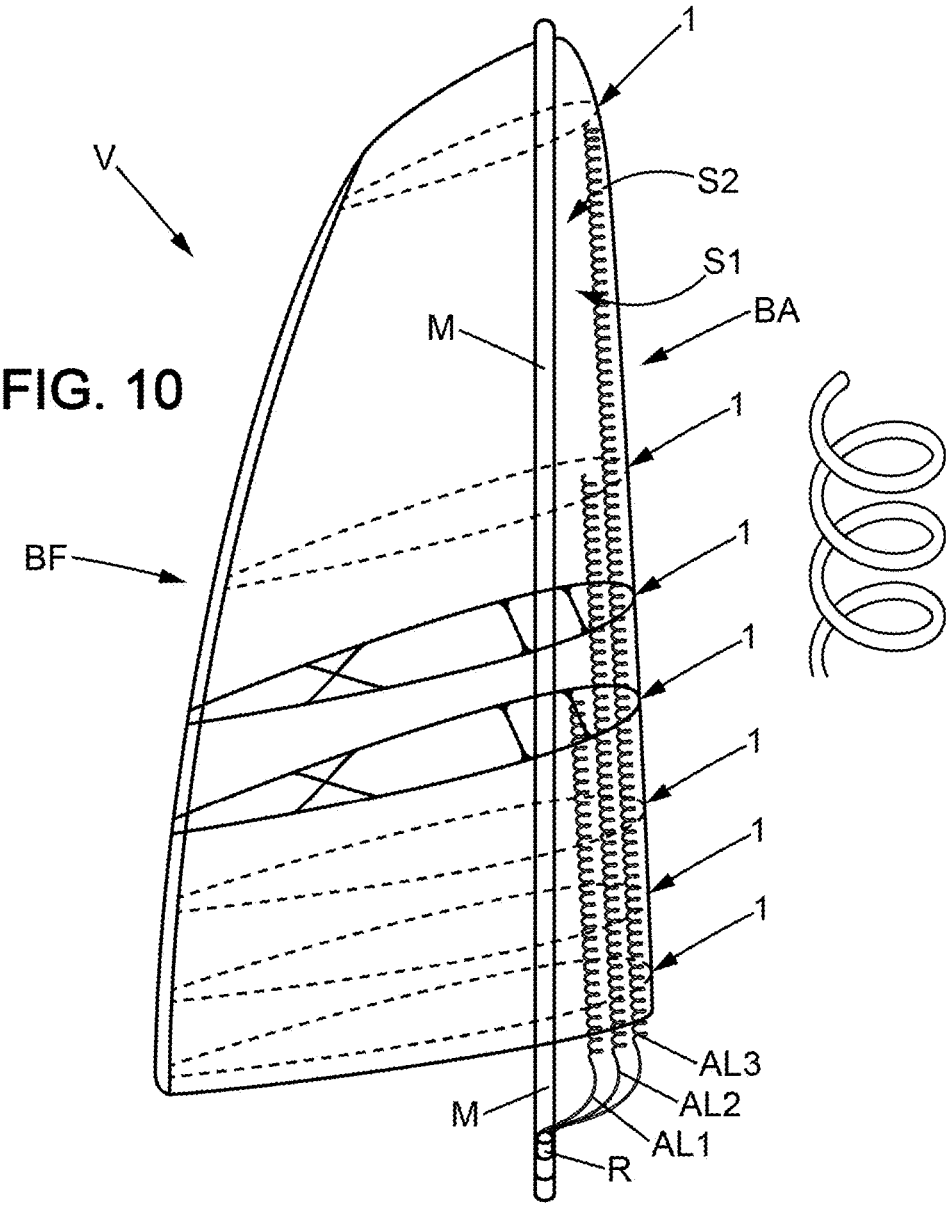

FIG. 10 is a view of the assembly comprising the profiled sail hoisted in the high position along the mast and the cambering devices at positions spaced apart from one another, illustrating in particular flexible elastic hoses for supplying pressurised fluid to the artificial muscles of the cambering devices and/or artificial muscles for girding the mast, the elastic hoses being shaped in a serpentine-like fashion, the hoses being deployed by spacing apart the turns of the serpentine.

Figure 11:
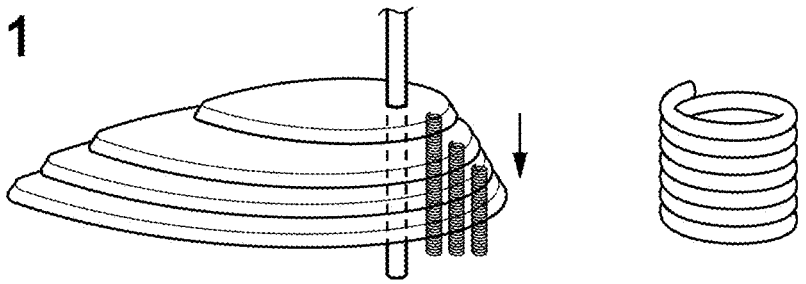

FIG. 11 is a view of the assembly of FIG. 10, once the profiled sail has been sprawled in the low position on the mast, the cambering devices at close positions in comparison with the view of FIG. 10, the hoses being retracted by bringing the turns of the serpentine close to one another under the elasticity of the serpentine.

Figure 12:
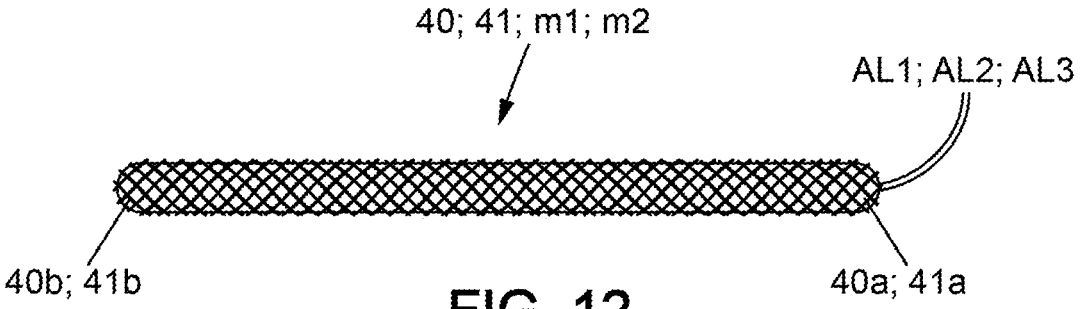

FIG. 12 is a schematic view of an artificial muscle in its non-activated position, namely the muscle discharged from the pressurized fluid.

Figure 13:
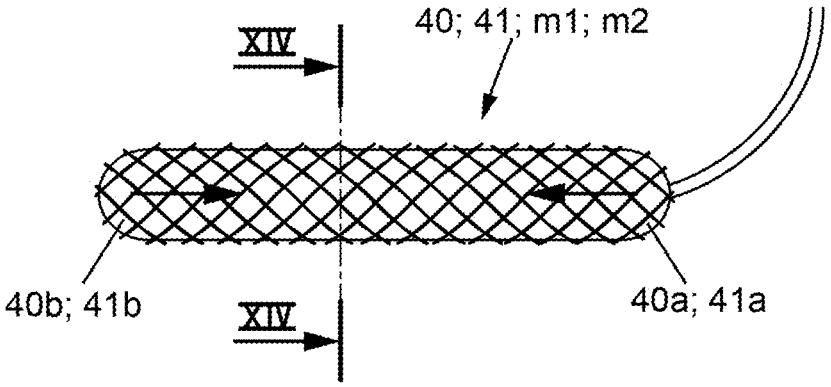

FIG. 13 is a schematic view of the artificial muscle of FIG. 12 in its activated position, namely the muscle supplied with the pressurized fluid, which causes an increase in its section and the lengthwise retraction of the actuator with its longitudinal ends approaching one another.

Figure 14:
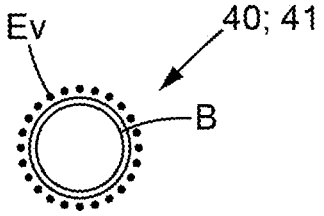

FIG. 14 is a sectional view of FIG. 13 illustrating in section the envelope in the form of a braid, and the (sealed) balloon received inside the envelope supplied with the pressurized fluid.

Figure 15:
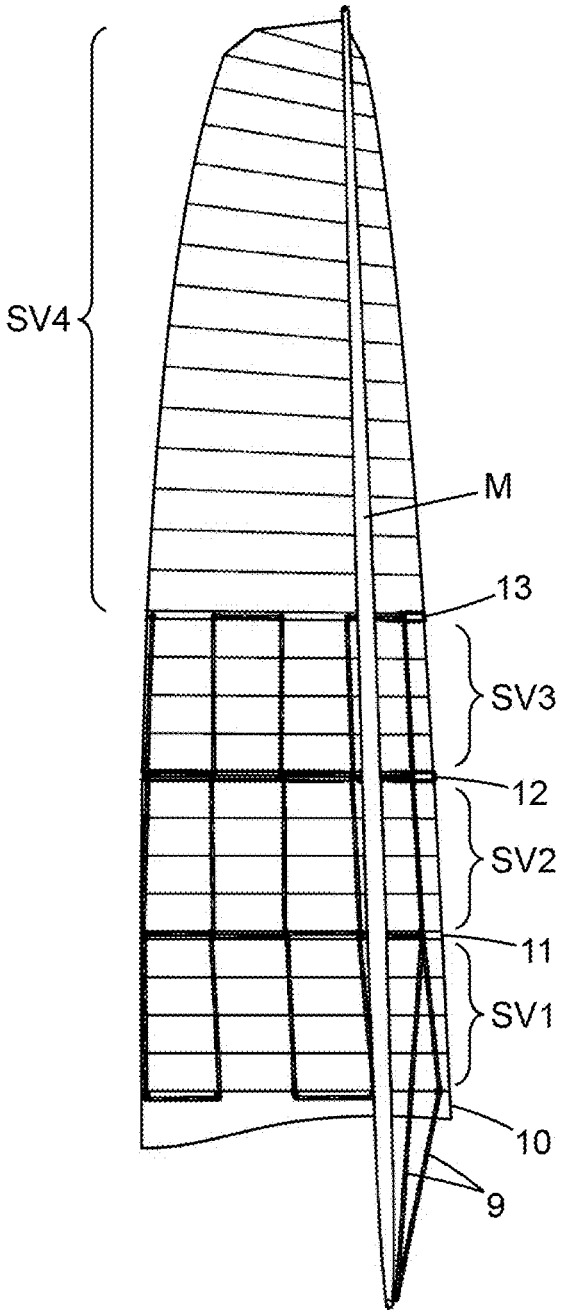

FIG. 15 is a view of an assembly according to the present disclosure in accordance with a second embodiment which comprises, in particular, a tightening device including one or more tightening link(s), guided by guides, inside the semi-rigid structures of the bottom cambering devices and the intermediate cambering devices.

Figure 16:
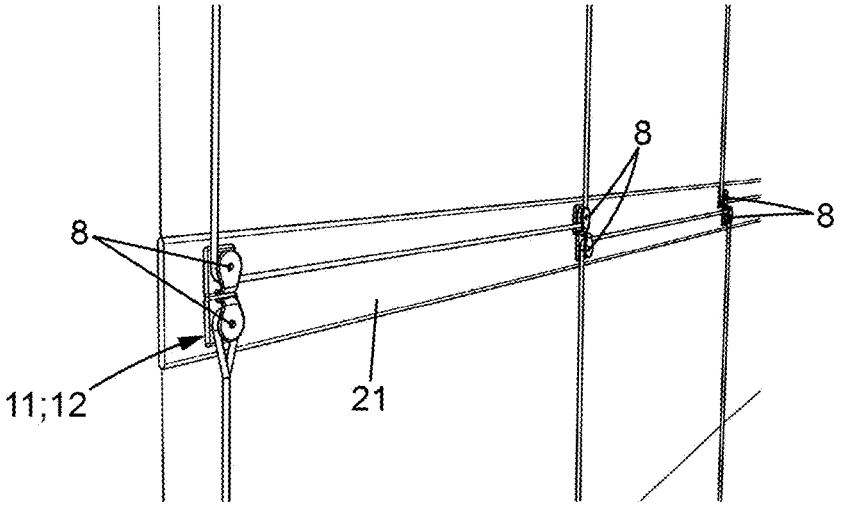

FIG. 16 is a detail view of the positioning of the guides along a length section of the semi-rigid structure inside the profiled sail.

Figure 17:
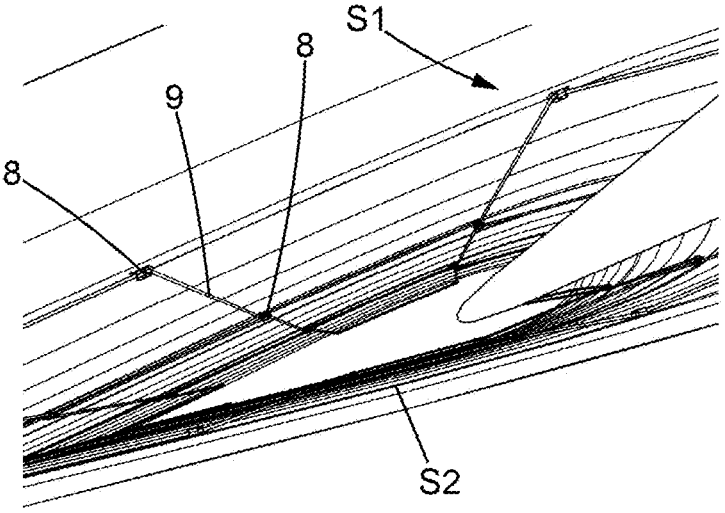

FIG. 17 is a detail view of the positioning of the guides along a length section of the semi-rigid structure inside the profiled sail.

Figure 18:
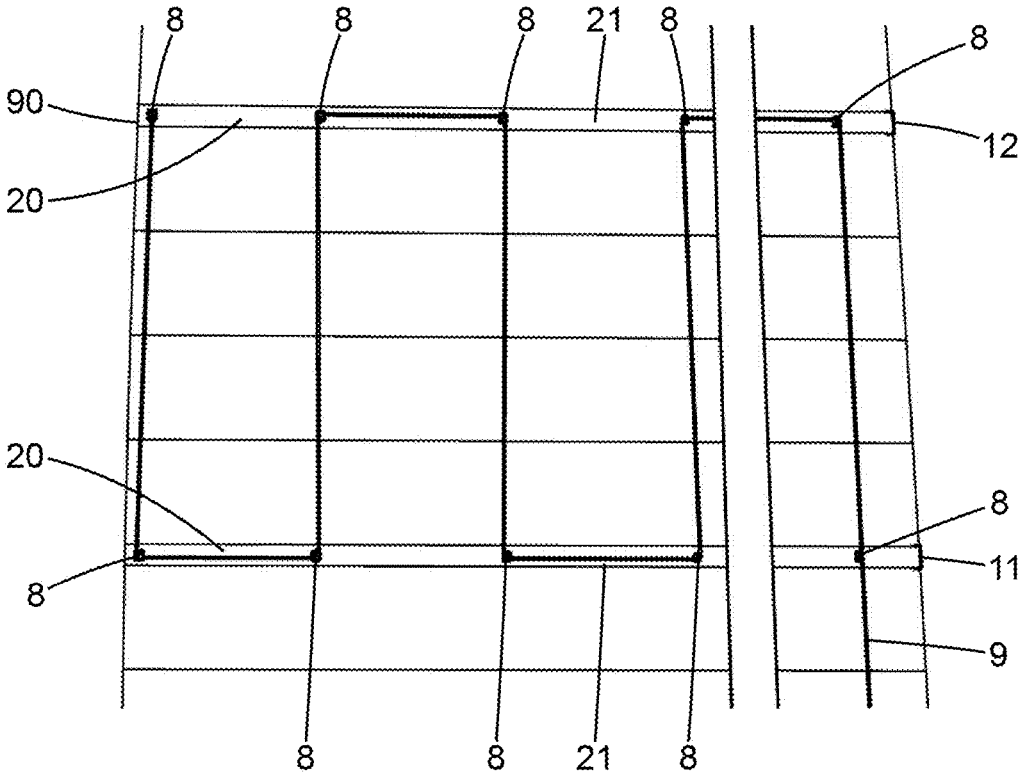

FIG. 18 is a detail view of the positioning of the guides positioned, alternately, on the rigid structures of two consecutive intermediate cambering devices, the guides being crossed through by the same tightening link, a tension on the link ensuring bringing the two intermediate cambering devices close to one another.

DETAILED DESCRIPTION

The drawings and the description hereinafter essentially contain elements of a certain nature. Hence, they could not only be used to better understand the present disclosure, but also contribute to the definition thereof, where appropriate.

Thus, the present disclosure relates to an assembly comprising a profiled sail; a mast and several cambering devices for a profiled sail.

All or part of the cambering devices comprise (for each cambering device):

- a semi-rigid structure, elastically deformable, including:
  - two length sections, extending in front of one another, respectively forming a first length section secured to a first surface of the profiled sail, and a second length section secured to a second surface of the profiled sail,
  - a U-shaped connecting section, interconnecting the first length section and the second length section while extending them at the leading edge of the profiled sail, the two length sections terminating at the trailing edge BF of the sail by two free ends,
- possibly, a spacer system, comprising at least one spacer interconnecting the first length section and the second length section, configured to work in compression and in tension, to keep a spacing between the two length sections.

Figure 4:
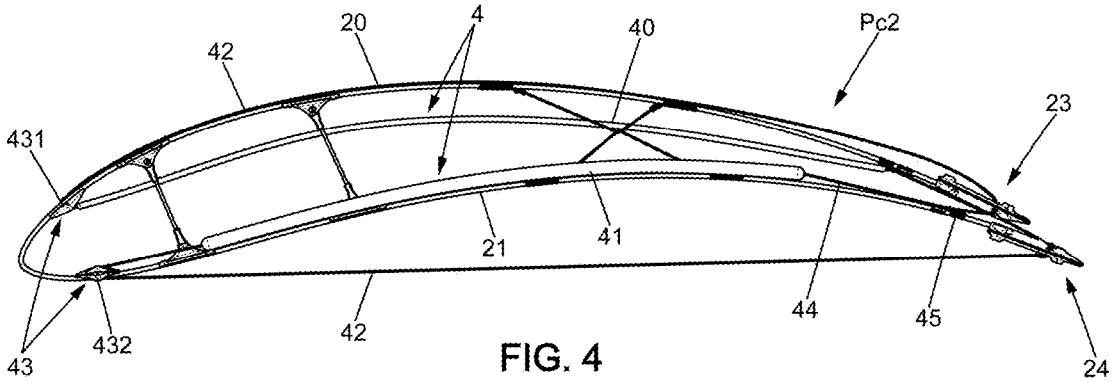
FIG. 4 is a view of the cambering device of FIG. 3, the actuating means being entirely illustrated, including the first actuator in the form of a pneumatic muscle running along the first length section in a deployed (non-activated) state, connected to the free end of the first section by an external tensioner via a first deflector, and connected to the free end of the second section by an internal tensioner, the actuating means also comprising a second actuator formed by a pneumatic muscle, in a retracted (activated) state connected to the free end of the second length section by an external tendon via a second deflector, and connected to the free end of the first length section by an internal tendon, the second actuator deforming the semi-rigid structure in a cambered position by tensioning between the free ends, on the one hand, and the second deflector secured to the U-shaped connecting section, on the other hand.
Figure 5:
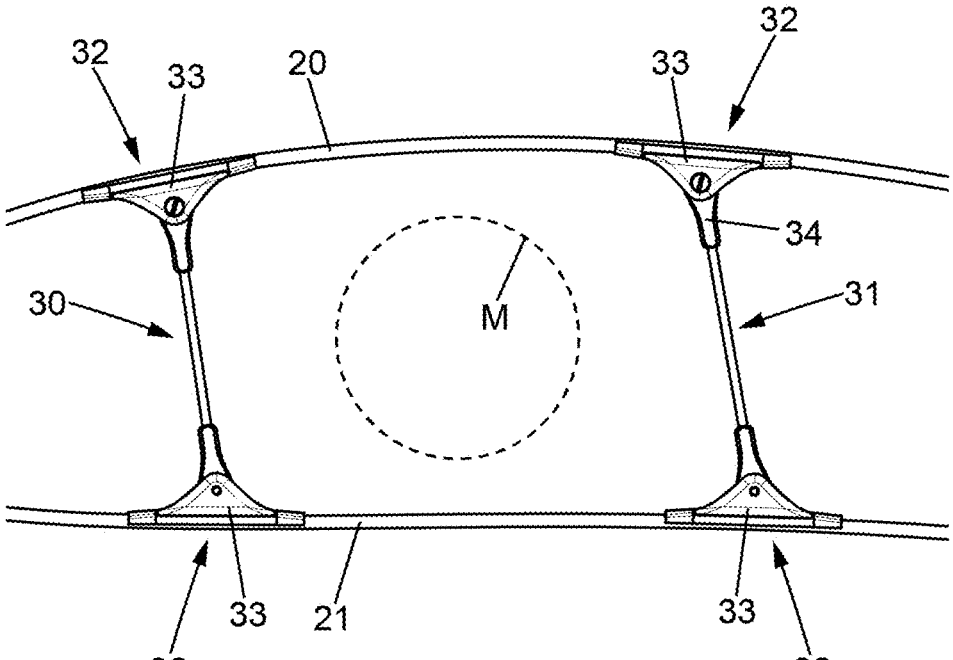
FIG. 5 is a detail view of the spacer system of the semi-rigid structure, including the first spacer and the second spacer.

The cambering device 1 may also comprise, according to a first possibility (illustrated in particular in FIG. 4), actuating means 4 interconnecting, on the one hand, the two free ends 23, 24 of the semi-rigid structure and, on the other hand, the U-shaped connecting section 22, configured to camber the first length section and the second length section of the semi-rigid structure by tensioning the two free ends 23, 24 with the U-shaped connecting section 22 of the semi-rigid structure 2, and the generation of an offset between the two free ends 23, 24.

According to a second possibility (not illustrated in the present application, but illustrated in particular in FIG. 11 or 12 of the document WO2021/148734A1), the cambering device 1 comprises actuating means 4 interconnecting, on the one hand, at least one of the two free ends 23, 24 and, on the other hand, the U-shaped connecting section 22, configured to camber the first length section and the second length section of the semi-rigid structure by tensioning one the two free ends 23, 24 with the U-shaped connecting section 22 of the semi-rigid structure 2 and the generation of an offset between the two free ends 23, 24.

Figure 1:
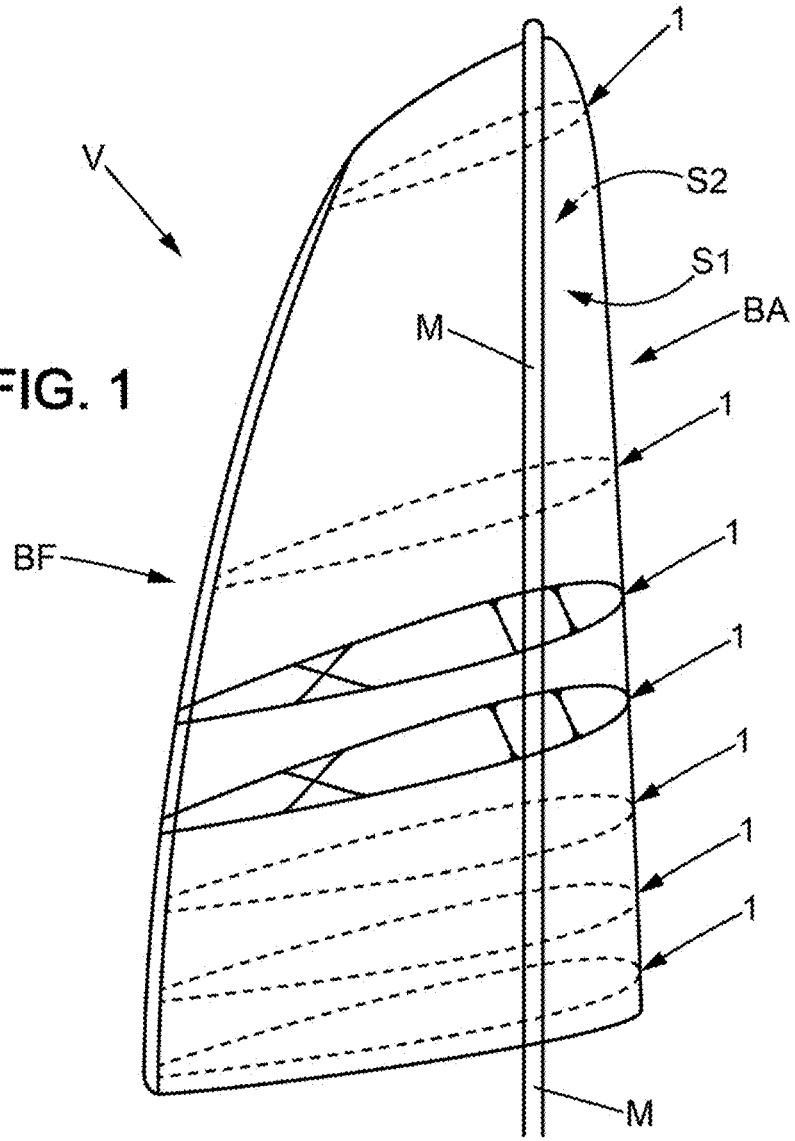
FIG. 1 shows in transparency a schematic view of a rigging including a profiled sail, as well as a plurality of cambering devices in their rest position, the cambering devices being configured to camber the profiled sail, selectively in a first direction and a second direction, the profiled sail being carried by a mast, extending inside the semi-rigid structures of the cambering devices.
Figure 1A:
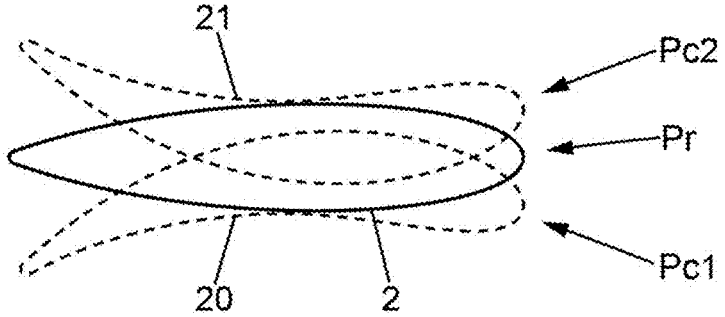
FIG. 1*a* is a schematic view of the section of the profiled sail, in solid line, in the rest position of the cambering device, and in dotted lines in two distinct cambered positions, in either direction with respect to the rest position.

As illustrated for indication in FIG. 1, a profiled sail may be provided with several cambering devices, over the height of the profiled sail. The cambering devices are distributed over the height of the profiled sail. The semi-rigid structure 2 of each cambering device 1 comprises the first length section 20 secured to a first surface S1 of the profiled sail V, and the second length section 21 secured to a second surface S2 of the profiled sail V, as well as the U-shaped connecting section 22, connecting together the first length section 20 and the second length section 21 while extending them at the leading edge BA of the profiled sail, the two length sections terminating at the trailing edge BF of the sail by two free ends 23, 24.

The flexible profiled sail extends from one of the free ends 23, 24 to the other, passing in front of the connecting section 22; a U-like shape forming the leading edge BA. The profiled sail may be fastened by two sail edges to the free ends 23, 24 via fastening means 6, in particular by pinching the sail edges.

Control means are configured to control, together in the same direction, the different actuating means 4 of the cambering devices to camber the first surface S1 of the profiled sail and the second surface S2 of the profiled sail. For example, the cambering devices may take on a (in particular first) cambered position for which the first length section 20 takes on a concave profile when the second length section takes on a convex profile and/or a (in particular second) cambered position in which said second length section 21 has a concave profile when said first length section 20 has a convex profile.

It should also be noted that an assembly in particular a rigging according to the present disclosure advantageously allows sprawling the profiled sail V, along the mast M, the cambering devices (with the possible exception of that one forming the boom); secured to the profiled sail, descending with the profiled sail along the mast, in particular when the halyard is relieved namely in the direction opposite to that of hoisting of the profiled sail.

Thus, the mast extends inside the semi-rigid structure, between the two length sections and wherein the profiled sail is configured to be:

- hoisted along the mast M, in a high position of the profiled sail, the cambering devices 1 in positions spaced apart from one another,
- sprawled along the mast M in the low position of the profiled sail, the cambering devices 1 in positions close to one another.

The present disclosure also relates to a vehicle comprising such a rigging: and in particular a sailing ship or sailing boat, or a sand-yacht.

The cambered position can be set during manoeuvres, for example by switching from the first cambered position Pc1 into the second cambered position Pc2 of the cambering devices (with opposite concavity) during edge change manoeuvres, whether tack manoeuvres or gybe manoeuvres.

The actuators used for the actuating means may be progressive (and not all or nothing) and take on several positions allowing cambering more or less strongly the first and the second sail surface, in either direction. It is possible to set the concavity of the surface of the sail exposed to the wind in order to maximise the force necessary for advancing the vehicle according to the wind conditions.

The lowest cambering device may simultaneously form a boom, in particular hinged to the mast, allowing orienting the profiled sail. The boom is oriented according to wind condition in the direction of travel of the ship.

The semi-rigid structure 2 comprising the connecting section 22 and the two length sections 20, 21, may be formed by a semi-rigid element made in one-piece, kept bent by the spacer system 3; and, where appropriate, a flexible connection system 5, which is described hereinafter.

For example, said one-piece element is a rod, in particular rectilinear at rest and bent to form the semi-rigid structure 2, or a blade in particular planar at rest and bent to form the semi-rigid structure. The rod or the blade is bent to form the first length section 20, the second length section 21 and the U-shaped connecting section 22. For example, the semi-rigid structure may be formed by a bent blade for the boom of the rigging and bent rods for the semi-rigid structures of the other cambering devices (located above the boom).

Alternatively, the different sections of the semi-rigid structure 2, including the first length section 20 and the second length section 21 and the connecting section 22, may be formed by several structural elements assembled together.

According to one embodiment, the cambering devices comprise all or part of the spacer system 3 which may comprise a first spacer 30, interconnecting the first length section 20 and the second length section 2, as well as a second spacer 31, interconnecting the first length section 20 and the second length section 21, parallel to said first spacer 30. The spacers have fixed or possibly telescopic lengths, as described in WO2021/148734A1 of the present Inventor. It should be noted that the mast extends between the spacers formed by the first spacer and the second spacer. The spacers (first and second) are configured to work in tension and in compression.

The features previously described in the detailed description are known per se from the document WO2021/148734A1. Nonetheless, the present disclosure focusses on the problem of reducing the useful surface area of the sail by folding it in order to adapt its dimensions in heavy weather. In sailing navigation, it is known to reduce the sail by folding it on the boom and according to a procedure known to a person skilled in the art as "reefing".

According to the prior art of mainsails, the triangular (non-profiled) sails comprise on the upper part a head to which the halyard is attached and a tack and a clew on the lower part of the sail. When the sail is hoisted to the high position, the sail is adjusted so that the luff (the front edge between the head and the tack) and the leech (the rear edge between the head and the clew) are properly strained to the desired tension.

In order to reduce the useful surface area of the mainsail in a high wind, the sail cloth typically comprises reefs (a first reef, a second reef, a third reef) respectively consisting of lacing holes, located at different heights above the clew and the tack.

After having eased the halyard and partially lowered the sail down to the reef (first reef/second reef), namely to the height of the boom, the lacing holes of the reefs are used for strain the edge of the sail. To this end, a rope, present on the leach of a sail, can be used. Second ropes typically called "reef points" are then used to furl the surplus and unused part of the sail to the base thereof after reefing. The reef-points typically pass through the lacing holes and have a sufficient length to hold the surplus of the sail by winding it around the boom.

Booms with drums that allow the reefing to be automated are also known. According to the observations of the Inventors, conventional reefing systems, with lacing holes according to the prior art of triangular sails, or with a drum, are not suitable for a profiled sail of an assembly according to the present disclosure and in particular disclosed in WO2021/148734A1.

The prior art with reefing lacing holes with reef points comprises ropes directly attached to the sail cloth, used for furling the surplus part of the sail, and which create local stresses on the cloth of the sail likely to cause ripping off in a strong wind with tearing of the sail.

The present disclosure improves the situation.

According to the present disclosure, said assembly advantageously comprises a system for reducing the surface area of the profiled sail exposed to the wind, configured to reduce the surface area of the profiled sail in an intermediate position along the mast between said high position of the profiled sail and the low position.

Such a system for reducing the surface area of the profiled sail exposed to the wind comprises, in particular, a plurality of sections SV1, SV2, SV3, SV4, SV5 of the profiled sail, distinct and separate, depending on the direction of the mast, made of a flexible cloth, with at least a first section SV1 of the profiled sail and a second section SV2 of the profiled sail.

By convention, the first section SV1 of the profiled sail, the second section of the profiled sail and more generally the $k^{th}$ section SVk of the profiled sail are arranged, along the height of the mast, one after another, from the bottom to the top of the mast M.

In general, the number of distinct sections SV1 to SV5 of the profiled sail is equal to an integer number N which may conventionally be comprised between 2 and 10, such that N is equal to 5.

The different sections SV1 to SV5 of the profiled sail can be made of the same material, in particular of the same cloth, or more advantageously of cloths having different properties, in particular of different materials and/or of different basis weights.

For example, the basis weight of the used cloth may be variable, for example increasing over the height of the mast (from the bottom to the top of the mast), in order to take into account, the gradient of the wind speed, generally increasing over the height of the mast.

In general, each section SV1 to SV5 of the profiled sail forms a portion of the first surface S1 and a portion of the second surface S2 of the profiled sail V and so as to be able to cooperate respectively with the first length section 20 and the second length section 21 of one or more of cambering devices 1, the section of the sail circumventing the U-shaped section 22.

The system for reducing the surface area of the profiled sail V exposed to the wind also comprises a plurality of said cambering devices 1 which are structural cambering devices.

The structural cambering devices comprise a bottom structural cambering device 10, typically forming a boom, and at least one intermediate cambering device 11, 12, 13, 14, said at least one intermediate cambering device 11, 12, 13, 14 ensuring the transmission of the forces due to the pressure of the wind on the profiled sail between two successive, separate and distinct sections of the profiled sail.

Figure 6:
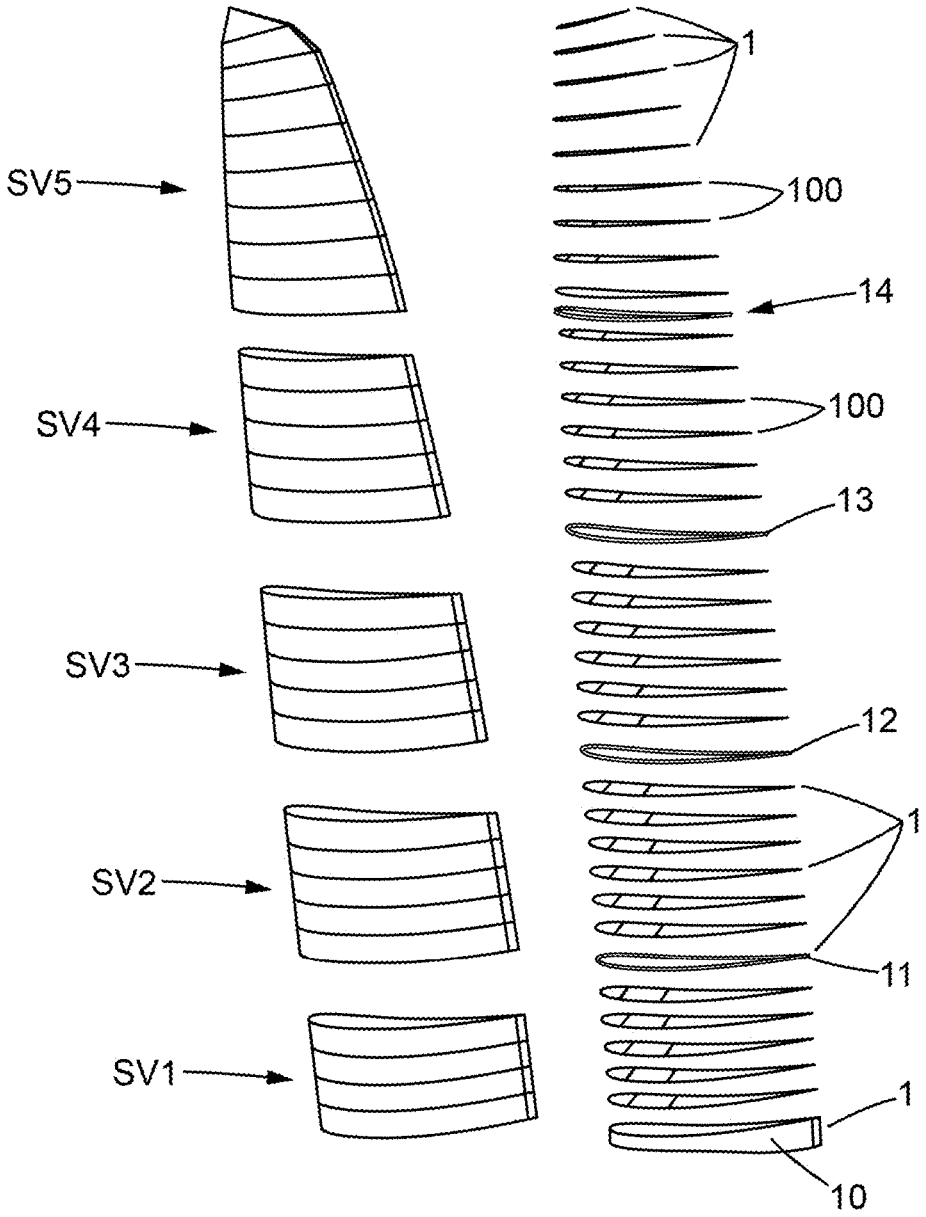
FIG. 6 is an exploded view of the profiled sail and the cambering devices, illustrating to the left different, separate and distinct sections of the profiled sail, namely a first section, a second, third, fourth and fifth sections of the profiled sail, and to the right, the cambering devices including, on the one hand, five structural cambering devices being part of the system for reducing the surface area of the profiled sail exposed to the wind, with from the bottom to the top, a bottom cambering device forming a boom, and first, second, third and fourth intermediate cambering devices and, on the other hand, secondary cambering devices, with a smaller height along the height, distributed above the bottom cambering device, interposed between the structural cambering devices, and possibly distributed above the highest structural cambering device, namely the fourth intermediate cambering device.

The number of structural cambering devices 10 to 14 of the system for reducing the surface area of the profiled sail exposed to the wind is equal to the integer number N of the sections of the profiled sail. Thus, in FIG. 6, the system for reducing the surface area of the profiled sail exposed to the wind is, for example, when the integer number N is equal to 5, namely it comprises five sections SV1 to SV5 of the profiled sail along the height of the mast, as well as five cambering devices, which consist of structural cambering devices, including a bottom cambering device 4 and four intermediate cambering devices 11 to 14 including:

- a bottom cambering device 10, typically forming the boom, connected to the lower edge of the first section SV1 of the profiled sail,
- a first intermediate cambering device 11, interposed and connected respectively to the first and second sections SV1, SV2 of the profiled sail,
- a second intermediate cambering device 12, interposed and connected respectively to the second and third sections SV2, SV3 of the profiled sail,
- a third intermediate cambering device 13, interposed and connected respectively to the third and fourth sections SV3, SV4 of the profiled sail,
- a fourth intermediate cambering device 14, interposed and connected respectively to the fourth and fifth sections SV4, SV5 of the profiled sail.

Besides the structural cambering devices of the system for reducing the surface area of the profiled sail, the cambering devices may comprise secondary cambering devices 100, typically of less height along the height, distributed above the bottom cambering device 10, interposed between the intermediate cambering devices 11, 12, 13, 14, and possibly distributed above the highest intermediate cambering device 14, i.e. the fourth intermediate cambering device 14.

The secondary cambering devices 100 cooperate with the different sections SV1 to SV5 of the profiled sail, each in an intermediate position of the section of the profiled sail between the upper edge and the lower edge of said section of the profiled sail.

In general and as visible in FIG. 9, the semi-rigid structure of the structural cambering devices 10, 11, 12, 13, 14 of the system for reducing the surface area of the profiled sail, exposed to the wind, gas a height dimension Lh, along the direction of the mast, which may be typically larger than the height dimension Ih of the secondary cambering devices 100. Thus, the structural cambering devices 10, 11, 12, 13, 14 of the system for reducing the profiled sail have a rigidity (along the direction of the mast) greater than the rigidity of the secondary cambering devices 100.

In general, a lower edge of the first section SV1 of the profiled sail is connected to the upper edge of the bottom cambering device 10, and an upper edge connected to the lower edge of the first intermediate cambering device 11, a lower edge of the second section SV2 of the profiled sail connected to the upper edge of the first intermediate cambering device 11, so that in the hoisted position of the profiled sail, the tensioned cloth of the first section SV1 of the profiled sail and the tensioned cloth of the second section SV2 of the profiled sail, extend along the direction of the mast, in a discontinuous manner.

The semi-rigid structure of the first intermediate cambering device 11, extends the first section SV1 of the profiled sail and the second section SV2 of the profiled sail in the high position of the profiled sail ensuring the transmission of the forces due to the pressure of the wind on the profiled sail between the first section SV1 of the profiled sail and the second section SV2 of the profiled sail.

When the system for reducing the surface area of the profiled sail comprises a second intermediate cambering device 12, the latter is connected to the upper edge of the second section SV2 of the profiled sail and to a lower edge of the third section SV3 of the profiled sail.

In general, and when the system for reducing the useful surface area comprises a $k^{th}$ intermediate cambering device, the latter is connected to an upper edge of the $k^{th}$ section SVk of the profiled sail and a lower $k^{th+1}$ section SVk+1 of the profiled sail.

In particular, the system for reducing the useful surface area of the profiled sail also comprises a removable fastening system, ensuring connection between the structural cambering devices, at least between the bottom cambering device 10 and said first intermediate cambering device 11, and possibly the connection between two successive intermediate cambering devices 11, 12, 13, 14, when the profiled sail is in an intermediate position between said high position of the profiled sail and the low position of the profiled sail, the structural cambering devices 10, 11, 12, 13, 14 then in positions close to one another on all or part, with at least the bottom cambering device 10 and the first intermediate cambering device 11 brought close to one another.

The accumulated surplus cloth of the first section SV1 of the sail is then preferably held by a link L1 of the fastening system joining the semi-rigid structure of the bottom cambering device 10 to the semi-rigid structure of the first intermediate cambering device 11.

Thus and in the view on the left of FIG. 7, the profiled sail V is illustrated in the high position along the mast M, the structural cambering devices 10 to 14 are in positions spaced from each other so as to ensure the deployment of the entirety of the useful surface area of the profiled sail, resulting in the addition of the different sections SV1 to SV5 of the profiled sail along the height of the mast.

The view at the middle of FIG. 7 illustrates a first reduction of the useful surface area of the profiled sail, or the "first reef", substantially reduced by the surface area of the first section SV1 of the profiled sail, obtained by partially sprawling the profiled sail from its high position illustrated to the left, namely until the first intermediate cambering device 11 sliding to the bottom of the mast, is close to the bottom cambering device 10 (then fixed). Thus, the first section of the profiled sail is folded, accumulated between the bottom cambering device 10 and the first intermediate cambering device 11.

Afterwards, a link of the fastening system is placed between at least the bottom cambering device 10 and the first intermediate cambering device 11 brought close to one another, the cloth of the first section SV1 of the sail, accumulated and held at least by the link L1 joining the semi-rigid structure of the bottom cambering device 10 to the semi-rigid structure of the first intermediate cambering device 11.

FIG. 7, to the right, also illustrates a second reduction of the surface area of the profiled sail, or "second reef", substantially reduced by the sum of the surface areas of the first section SV1 of the profiled sail and of the second section SV2 of the profiled sail, obtained by partially sprawling the profiled sail from its high position illustrated on the left, namely until the first intermediate cambering device 11 and the second intermediate cambering device 12 sliding to the bottom of the mast, are proximate to the bottom cambering device 10 (then fixed). The first section SV1 of the profiled sail and the second section SV2 of the profiled sail are then folded, accumulated respectively between the bottom cambering device 10 and the first intermediate cambering device 11, on the one hand, and between the first intermediate cambering device 11 and the second intermediate cambering device 12, on the other hand.

Afterwards, a link of the fastening system is placed between the bottom cambering device 10 and the first intermediate cambering device 11 brought close to one another, the cloth of the first section SV1 of the sail, accumulated and held at least by the link L1 joining the semi-rigid structure of the bottom cambering device 10 to the semi-rigid structure of the first intermediate cambering device 11, as well as at least one additional link L2 joining the first intermediate cambering device 11 and the second intermediate cambering device 12.

In general, and as it should be understood from the present description, for a profiled sail having an integer number N of sections of the profiled sail, a bottom cambering device 10 and N−1 intermediate cambering devices, it is possible to proceed with N−1 reductions of the surface area of the profiled sail, by N−1 successive decreases of the sections of the profiled sail.

Advantageously, the fastening system typically comprises hooking points PT such as lugs or hooks projecting outwardly along the first length section 20 and the second length section 20 of the semi-rigid structures of the structural cambering devices 10, 11, 12, 13, 14, as well as at least one flexible link L1, L2 configured to hook on the hooking points PT of two intermediate cambering devices when the profiled sail is in said intermediate position with the two successive cambering devices approaching one another, while holding the section of the sail accumulated and connected to two successive cambering devices.

The two successive structural cambering devices may be the bottom cambering device 10 and the first intermediate cambering device 11, connected by the link L1, or two successive intermediate cambering devices 11, 12, 13, 14 connected by an additional link L2.

According to the present disclosure, the link L1 (or the additional link L2) directly hooks on the semi-rigid structures of the structural cambering devices, without creating any local tension on the sections SV1, SV2, SV3, SV4, SV5 of the profiled sail and therefore without creating any local stresses on the cloth that might be at the origin of ripping off in a strong wind.

The structural cambering devices, i.e. the bottom cambering device 10 and the intermediate cambering devices 11, 12, 13, 4 thus advantageously ensure a homogeneous transmission of the force to the different sections of the profiled sail, over the entire profile of the section SV1 to SV5 of the sail, seen along a perpendicular to the mast. The hooking points may consist of hooks or lugs with widened ends.

Optionally, all or part of the cambering devices may have a securing system 7, able to be activated/deactivated, configured to ensure securing of the cambering device 1 on the mast, the securing system 7.

In its activated state, the securing system 7 is advantageously configured to keep the mast at a distance from the semi-rigid structure of the device while ensuring deflection of the lateral support due to the pressure of the wind on the profiled sail on the mast. The securing system 7 positions the profiled sail while avoiding impacts between the mast M and the semi-rigid portions of the cambering device that could be damaged.

As visible for indication in FIG. 9, the securing system 7 comprises:

- a first flexible strand 71 linked to the first length section 21 by two longitudinal ends of the first strand 71, the first strand circumventing the mast M from the first length section 20,
- a second flexible strand 72 linked to the second length section 20 by two longitudinal ends of the second strand, the second strand circumventing the mast M from the second length section 21.

Thus, the mast extends between the first strand 71 and the second strand 72.

The securing system further comprises an actuator system, able to be activated, internal to the structure, configured to pass the first strand and the second strand in a retracted state configured to tighten the cambering device onto the mast M, clasped between the first strand 71 and the second strand 72, inside the semi-rigid structure.

According to one embodiment, the cambering devices comprise all or part of the spacer system 3 with a first spacer 30, interconnecting the first length section 20 and the second length section 21, as well as a second spacer 31, interconnecting the first length section 20 and the second length section 21, parallel to said first spacer (30).

Advantageously, the mast thus clasped by the first strand 71 and the second strand 72 is held at a distance from the two length sections 20, 21 by the tensioned first strand 71 and second strand 72, as well as held at a distance from the spacers, the first spacer 31 and the second spacer 32 when present. The force of the wind on the profiled sail is diverted to the mast by the tensioned first strand 72 and second strand 72.

Conversely and when the actuator system is deactivated, the latter is configured to cause a deployed state of the first strand and second strand configured to release the mast; and to enable movement of the cambering device along the mast.

In order to optimise the synergy between the spacers 30, 31 and the strands 71, 72:

- the longitudinal ends of the first strand 71 may be secured at two attachment points on the first length section 20 respectively at the junction areas between the first and second spacers 30, 31, on the one hand, and the first length section 20, on the other hand,
- the longitudinal ends of the second strand 72 may be secured at two attachment points on the second length section 21 respectively at the junction areas between the first and second spacers 30, 31, on the one hand, and the second length section 21, on the other hand.

Each spacer consisting of the first spacer and the second spacer 30, 31 of the spacer system 3 can be pivotably hinged at its ends, respectively to the first length section 20 according to an axis perpendicular to the plane of the semi-rigid structure and to the second length section 21 according to an axis perpendicular to the plane of the semi-rigid structure, the or each spacer 30, 31 being configured to pivot relative to the two length sections, the first length section 20 and the second length section 21 during cambering and offset of the free ends 23, 24; under the effect of the actuating means 4.

To this end, the cambering device may comprise hinged connectors 32, comprising a first portion 33 secured to the first length section 20 or to the second length section 21, and possibly a second portion 34 receiving one end of the spacer 30; 31, the second portion 34 being hinged to the first portion 33 according to a pivot axis substantially perpendicular to the plane of the semi-rigid structure 2 to pivot relative to the two length sections during cambering and offset of the free ends 23, 24; under the effect of the actuating means.

Besides, the longitudinal ends of the first strand 71 may advantageously be attached to the first portions 33 of the connectors 32 secured to the first length section 20 and the longitudinal ends of the second strand 72 are attached to the first portions 32 of the connectors 32 secured to the second length section 21.

According to one embodiment, the actuator system of the securing system 7 comprises at least one girding actuating member m having two longitudinal ends e1, e2, said actuating member, able to be activated, being retractable when activated with its two longitudinal ends e1, e2 brought close to one another.

Said girding actuating member may be an artificial muscle, in particular a pneumatic muscle. Such an actuator has an envelope internally receiving a balloon supplied with or discharged from the fluid. The flexible envelope retracts lengthwise when its section increases under the increase of the balloon supplied with fluid (contraction of the muscle), and deploys lengthwise when its section decreases when the balloon is discharged from the fluid (decrease in the pressure of the fluid). The retraction of the actuator may be progressive by controlling the amount of the fluid supplied into the balloon.

Such pneumatic actuation systems are commonly referred to as "artificial muscles" consisting of inflatable tubes inserted into protective braids forming an envelope, such that the artificial muscle contracts or expands depending on whether its internal fluid pressure increases or decreases. Such artificial muscles are described, for example, by B. Tondu and P. Lopez in "Compte Rendu de l'Académie des Sciences", t. 320, PP 105-114, 1995.

Such an artificial muscle is schematically illustrated in its deployed position in FIG. 12 and in its retracted position in FIG. 13, as well as according to a sectional view in FIG. 14.

When the balloon B is supplied with pressurized fluid (for example air), the section of the balloon increases, which causes an increase in the section of the envelope Ev in the form of a braid in FIG. 11.

Under the effect of the increase in the section of the envelope, braiding of the envelope generates a force ensuring the retraction of the artificial muscle, by bringing the longitudinal ends e1 or e2 close to one another.

Such an actuator has the advantage of:

- requiring no electrification of the profiled sail,
- being a flexible component; unable to be aggressive for the surfaces of the profiled sail, thereby avoiding the risks of tearing, and even able to come directly into contact to clasp the mast without any risk of altering the surface of the mast M.

According to a first embodiment illustrated in FIG. 9, the first strand 71 may comprise a first girding actuating member m1, in particular a first artificial muscle, and the second strand 72 may comprise a second girding actuating member m2 in particular a second artificial muscle.

All or part of the cambering devices 1 may have a flexible connection system 5 joining together the first length section 20 and the second length section 21. This flexible connection system is arranged in an intermediate position of the structure between the two free ends 23, 34 and said spacer system 3, said flexible connection system 5, working in tension to keep a spacing between the two length sections.

It should also be noted that both the spacer system 3 and the flexible connection system 5 extend inside the semi-rigid structure 2, in the inter-space between the first length section 20 and the second length section 21, and preferably entirely in the plane of the semi-rigid structure 2.

The flexible connection system 5 includes two flexible links, including a first flexible link 50 secured by its two ends to the first length section 20, and a second flexible link 51 secured by its two ends to the second length section 21. The two flexible links, the first flexible link 50 and the second flexible link 51, are interleaved at a contact area Zc between the two links 50, 51. The contact area Zc between the two flexible links is configured to slip along the flexible links 50, 51 during cambering and offset of the free ends 23, 24; under the effect of the actuating means 4.

Thus, and whether the spacer system, when the or each spacer is hinged at its ends to the two length sections (first length section 20 or second length section 21), or the flexible connection system with the possibility of slipping of the contact area between the two flexible links, these two systems promote the offset between free ends 23, 24, when the actuating means 4 are activated.

The semi-rigid structure 2 may have a profile having a plane of symmetry, in a rest position Pr of the semi-rigid structure 2 in which the first length section 20 and the second length section 21 have a convex profile. As visible in FIG.

2, the plane of symmetry AS of the semi-rigid structure 2 in the rest position thereof extends according to the direction between the leading edge BA and the trailing edge BF, perpendicular to the plane of the semi-rigid structure 2 containing the first length section 20, the second length section 21 and the U-shaped connecting section 22.

In the rest position Pr of the semi-rigid structure, one could notice that the first spacer 30 and the second spacer 31 extend respectively substantially perpendicular to the plane of symmetry AS.

In at least one cambered position Pc1 and/or Pc2 of the semi-rigid structure 2 under the action of the actuating means 4, said first length section 20 has a concave profile when said second length section 21 has a convex profile, or said second length section 21 has a concave profile when said first length section 20 has a convex profile.

According to one embodiment, the actuating means 4 are configured to selectively camber the semi-rigid structure:

- in a first cambered position Pc1 in which said first length section 20 has a concave profile when said second length section 21 has a convex profile,
- in a second cambered position Pc2 in which said second length section 21 has a concave profile when said first length section 20 has a convex profile.

According to one embodiment (in particular illustrated in FIG. 4), the actuating means 4 may comprise at least one actuator 40, 41, extending along one of the two length sections of the structure, the first length section 20 (or the second length section 21), connected to the free end 23 or 24 of the length section by a flexible external tendon 42, external to the semi-rigid structure 2, via at least one deflector 43 secured to the U-shaped connecting section, and connected to the free end 24, 23 of the other length section by an internal tendon 44 which runs along the length section up to a guide 45, before connecting said free end 24 or 23 of the other length section, the second length section 21 or the first length section 20.

Said at least one deflector 43 is located on the side of the plane of symmetry (and not on the latter) of the semi-rigid structure 2 the profile of the length section of which is to be changed (the first length section or the second length section) of the convex profile towards the concave profile.

When the actuating means allow obtaining the two cambered positions Pc1 and Pc2, two deflectors arranged on both sides of the plane of symmetry respectively allow cambering the semi-rigid structure in these two cambered positions

- a first deflector 431, secured to the connecting section 22, arranged on the side of the first length section 20 (with respect to the plane of symmetry) is loaded to enable the change of profile of the first length section 20 (and therefore the first surface S1 of the profiled sail) of the convex profile in the rest position Pr of the semi-rigid structure 2 up to said first cambered position Pc1 where the first length section 20 takes on the concave profile;
- a second deflector 432, secured to the connecting section; arranged on the side of the second length section 21 (with respect to the plane of symmetry), is loaded to enable the change of profile of the second length section 10 (and therefore the second surface S2 of the profiled sail) of the convex profile in the rest position Pr of the semi-rigid structure 2 up to said second cambered position Pc2 where the second length section 21 takes on the concave profile.

Said actuator 40; 41 is configured to retract into an active state and pull on the two free ends 23, 24 respectively connected by the external tendon 42 and the internal tendon 44, on the one hand, and on the deflector 43 of the connecting section 22, on the other hand, until creation of the offset d, the free end connected by the internal tendon 44 advancing towards the leading edge BA relative to the free end connected by the external tendon 42 while causing cambering of the semi-rigid structure, the loaded external tendon 42 moving away from the length section, the first length section (or the second length section, immediately contiguous to the external tendon 42), which then takes on a concave profile, and while the other length section, the second length section or the first length section, takes on a convex profile.

The offset of the free ends 23, 24 allows initiating the change in profile of the length section—the first length section 20 or the second length section—from the convex profile in the rest position Pr of the structure semi-rigid 2, and up to the concave profile in said cambered position, in particular the first cambered position Pc1 or the second cambered position Pc2.

The change in the profile of the first length section 20, in particular from the convex profile in the rest position Pr up to a concave profile in the first cambered position Pc1, is initiated by offset of the free end 24 of the second connecting section 21 towards the leading edge BA relative to the free end 23 of the first connecting section 20.

Henceforth, the concavity of the first length section 20 may be accentuated by the actuating means 4, by the tension of the external tendon 42 connecting the first deflector 431 and the free end 23 (like a bowstring).

The change in the profile of the second length section 21, in particular the convex profile in the rest position Pr up to a concave profile in the first cambered position Pc2 is initiated by offset of the free end 23 of the first length section 20 towards the leading edge BA relative to the free end 24 of the second length section 21.

Henceforth, the concavity of the second length section 21 may be accentuated by the actuating means 4, by the tension of the external tendon 42 connecting the second deflector 432 and the free end 24 (like a bowstring).

By "external tendon" 42, it should be understood the fact that the flexible tendon passes outside the semi-rigid structure 2, and outside the sail between the deflector 43—the first deflector 431 or the second deflector 432—and respectively the end free, respectively the free end of the first length section 20 and the end 24 of the second length section 21, and even in the case where the flexible tendon is partially internal to the structure between the deflector and the actuator (the first actuator 40 or the second actuator 41).

According to one embodiment (illustrated in FIG. 4), the external tendon 42 between the deflector (the first deflector 431 or the second deflector 432) and the free end (the free end 23 or 24) is still external to the profiled sail, in particular external to the first sail surface S1 between the first deflector 431 and the free end 23 and external to the second sail surface S2 between the second deflector 432 and the free end 24. To this end, the sail first surface S1 (respectively the sail second surface S2) has a passage opening for the external tendon 42 at the first deflector 431 (respectively at the second deflector 432).

When the first sail surface S1 takes on a concave surface under the action of the first length section 20, the external tendon 42 also deviates from this first surface S1 of the profiled sail.

When the second sail surface S2 takes on a concave surface under the action of the second length section 21, the external tendon 42 also deviates from this first surface S2 of the profiled sail.

According to one embodiment (illustrated in FIG. 4), the actuating means comprise:

a first actuator 40 configured to camber the semi-rigid structure in said first cambered position Pc1, extending along the first length section 20 connected to the free end 23 of the first length section by a flexible external tendon 42, to the semi-rigid structure 2, via a first deflector 431 secured to the U-shaped connecting section 22 and by an internal tendon 44 which runs along the first length section 20 up to a guide 45 of said first length section 20 before connecting the free end 24 of said second length section 21, the first actuator 40 being configured to retract and pull on the two free ends 23, 24 connected by the external tendon 42 and the internal tendon 44, on the one hand, and on the first deflector 431, on the other hand, until the creation of an offset denoted d, the end 24 connected by the internal tendon 44 advancing towards the leading edge BA with respect to the free end 23 connected by the external tendon 42, causing cambering of the semi-rigid structure, the external tendon 42 being loaded, moving away from the first length section 20 which takes on a concave profile, the second length section 21 taking on a convex profile in said first cambered position Pc1, a second actuator 41 configured to camber the semi-rigid structure of said second cambered position Pc2, extending along the second length section 21 connected to the free end 24 of the second length section by a flexible external tendon 42, to the semi-rigid structure 2, via a second deflector 432 secured to the U-shaped connecting section 22, and by an internal tendon 44 which runs along the second length section 21 up to a guide 45 of said second length section 21 before connecting the free end 23 of said first length section 20, the second actuator 41 being configured to retract and pull on the two free ends 23, 24 connected by the external tendon 42 and the internal tendon 44, on the one hand, and on the first deflector 432, on the other hand, until the creation of an offset denoted d, the free end 23 connected by the internal tendon 44 advancing towards the leading edge BA with respect to the free end 24 connected by the external tendon 42, causing cambering of the semi-rigid structure 2, the external tendon 42 being loaded, moving away from the second length section 21 which takes on a concave profile, while said first length section 20 takes on a convex profile in said second cambered position Pc2.

According to one embodiment, the cambering device comprising a control means configured to selectively:

activate the first actuator 40 while keeping the second actuator 41 not activated to cause said first cambered position Pc1, activate the second actuator 41 while keeping the first actuator 40 not activated to cause said second cambered position Pc2.

The first actuator 40 and the second actuator 41 are selectively activated, in particular when the first strand 71 and the second strand 72 are in said retracted state configured to tighten the cambering devices on the mast M by activation of said securing systems 7 when present.

These control means may be external to the semi-rigid structure of the cambering device.

The control means may also allow adjusting the setting of the concavity depth when the actuator, the first actuator 40 and/or the second actuator 41, is a progressive actuator.

Said at least one actuator, where appropriate the first actuator 40 and the second actuator 41, may be an actuator that retracts when supplied with fluid such as an artificial muscle, in particular a pneumatic muscle. Such an actuator, illustrated in FIGS. 12 to 14, has already been described before, and is not described again. It has an envelope internally receiving a balloon supplied with or discharged from the fluid. The flexible envelope retracts lengthwise when its section increases under the increase of the balloon supplied with fluid (contraction of the muscle), and deploys lengthwise when its section decreases when the balloon is discharged from the fluid (decrease in the pressure of the fluid). The retraction of the actuator may be progressive by controlling the amount of the fluid supplied into the balloon.

According to one embodiment, the artificial muscles of the actuators 40, 41 and/or of the girding actuating members m1 and m2 of the plurality of cambering devices 1 are supplied with fluid by one or more flexible elastic hose(s) AL1, AL2, AL3, shaped in the form of a serpentine, extending according to the direction of the height of the mast M. The flexible elastic hose(s) is/are configured to be deployed by spacing the turns of the serpentine in the high position of the profiled sail, and to retract by bringing the turns of the serpentine close to one another under the elasticity of the serpentine, in the low position of the profiled sail.

Distinct elastic hoses are used for the actuators 40, 41 configured for cambering and the girding actuating members m1, m2, in order to be able to control these different actuators independently.

The girding actuators or actuating members may be supplied with fluid by a reserve of compressed fluid R in particular compressed air which may be accommodated in the hollow of the mast at its base.

INDUSTRIAL APPLICATION

The present technical solutions may find application in particular in the maritime field of sailboats, as an improved rigging solution.

The cambering devices being composed of an elastically-deformable semi-rigid structure, or, where appropriate, of one or more flexible actuator(s) in the form of artificial muscles, it is particularly suitable for a marine environment, where the rigging elements might be subjected to impacts, under the action of wind or of unforeseen manoeuvres.

Advantageously, the system for reducing the surface area of the profiled sail exposed to the wind allows reducing the useful surface of the profiled sail, without creating any local tension on the cloth of the profiled sail, thereby limiting the risk of ripping off by a strong wind.

On the contrary, the structural cambering devices, in particular the intermediate cambering devices enable homogeneous transmission and distribution of forces due to the pressure of the wind on the sail between the distinct sections of the profiled sail.

In particular, the homogeneous distribution between each section of the profiled sail and the intermediate, structural cambering devices can advantageously operate preferably continuously along the first length section, and along the second length section of the rigid structure, as well as along the U-shaped connecting section of the structure 2, and in order to distribute the load along the first surface area of the sail and along the second surface area of the sail of each section, as well as along the surface area of the sail circumventing the U-shaped connecting section.

During maintenance, in particular in the case of a deterioration of the cloth of the profiled sail, only the section of the profiled sail featuring an alteration can be disassembled from said assembly, advantageously while keeping assembled, the other, unaltered, sections of the profiled sail. Maintenance of the sail is therefore simplified.

The present disclosure also relates to a method for reducing the surface area of the profiled sail exposed to the wind from an assembly according to the present disclosure or belonging to a sailboat according to the present disclosure from a high position of the profiled sail on the mast, the cambering devices 1 in positions spaced apart from one another.

According to this method, it is proceeded with the reduction of the surface area of the profiled sail exposed to the wind by:

- partially sprawling the profiled sail into an intermediate position between said high position of the profiled sail and the low position, and by bringing at least the bottom cambering device 10 and said first intermediate cambering device 11 close to one another, or even two successive intermediate cambering devices 11 to 14, the structural cambering devices being in positions close to one another in all or part,
- placing a link of the fastening system between at least the bottom cambering device 10 and the first intermediate cambering device 11 brought close to one another, the cloth of the first section SV1 of the sail accumulated and held at least by the link L1 joining the semi-rigid structure of the bottom cambering device 10 to the semi-rigid structure of the first intermediate cambering device 11, for obtaining a first reduction of the surface area of the profiled sail, and possibly placing at least one additional link L2 between the successive intermediate cambering devices 11, 12, 13, 14, the intermediate link holding the section of the sail accumulated between said intermediate cambering devices, to obtain additional reductions of the surface area of the profiled sail.

According to an embodiment illustrated as an example in FIGS. 15 to 19, the system for reducing the surface area of the profiled sail exposed to the wind includes a tightening device, configured to bring two structural cambering devices close to one another, in particular the bottom cambering device with the intermediate cambering device(s), or also configured to bring two intermediate cambering devices close to one another, the tightening device comprising:

- guides 8 such as castors, secured to the rigid structure 2 of two structural cambering devices to be brought close to one another, the guides being arranged on an inner side of the semi-rigid structure 2, along the first length section 20 and/or along the second length section 21,
- at least one tightening link 9 extending within the profiled sail, and which runs along the guides 8 while being guided by the guides, the guides being arranged alternately on the two cambering devices along the pathway of the link, the fixed link at a distal end 90 on the semi-rigid structure of one of the two cambering devices to be brought close to one another.

The tightening device is configured so that a tension on the tightening link 9 causes the two structural cambering devices to be brought close to one another.

In general, in order to bring two structural cambering devices close to one another, and symmetrically with respect to a vertical midplane of the profiled sail, there could be:

- a first tightening link extending between the semi-rigid structures 2 in the guides 8 alternately fastened to the first length sections 20 of the semi-rigid structures,
- a second tightening link extending between the semi-rigid structures in the guides 8 alternately fastened to two length sections 20 of the two semi-rigid structures.

The two structural cambering devices are brought close to one another, by simultaneously pulling on the first and second tightening links.

FIG. 17 illustrates the profiled sail in top view, the tightening device, in particular said guides 8 and the tightening links 8 being inside the profiled sail, laid out the two surfaces S1 and S2 of the sail and inside the semi-rigid structures of the cambering devices.

FIG. 18, illustrates an example of the trajectory of the tightening link 9 which extends throughout the guides 8, distributed alternately on the semi-rigid structures along the pathway of the link 9, up to the distal end 90 fastened on one of the structures. The proximal end of the tightening link is strained and can be fastened to the bottom of the mast.

In general, there could be a plurality of tightening systems and in particular:

- a first tightening device between the bottom cambering device 10 and the first intermediate cambering device 11 configured to bring the bottom cambering device and the first intermediate cambering device 11 close to one another,
- a second one between the first intermediate cambering device 11 and the second intermediate cambering device 12, and so on.

Such a tightening device may form as such a version of the removable fastening system, ensuring connection between the structural cambering devices. Of course, the approach caused by a tension on the tightening link 9 requires easing the halyard beforehand.

In particular, such a tightening device can enable automation of a partial sprawling manoeuvre of the sail when the tension on the tightening link is motor-driven.

LIST OF THE REFERENCE SIGNS

Figure 2:
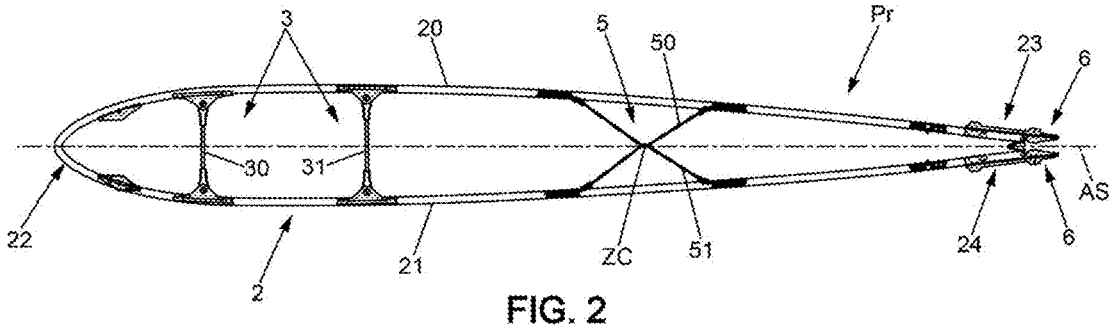
FIG. 2 shows an embodiment of the cambering device (the flexible tendon and the pneumatic muscles of the actuating means not illustrated) including the semi-rigid structure, in its rest position, formed of a bent rod forming the connecting section, the first length section and the second length section, as well as a first deflector and a second deflector, each comprising a pulley, a spacer system including a first spacer and a second spacer, a flexible connection system, including a first flexible link and a second flexible link interleaved with each other, and fastening means for the edge of each profiled sail, at each free end of the semi-rigid structure, as well as two guides secured to the first and second length sections proximate to the free ends, ensuring guidance of the flexible tendons.
Figure 3:
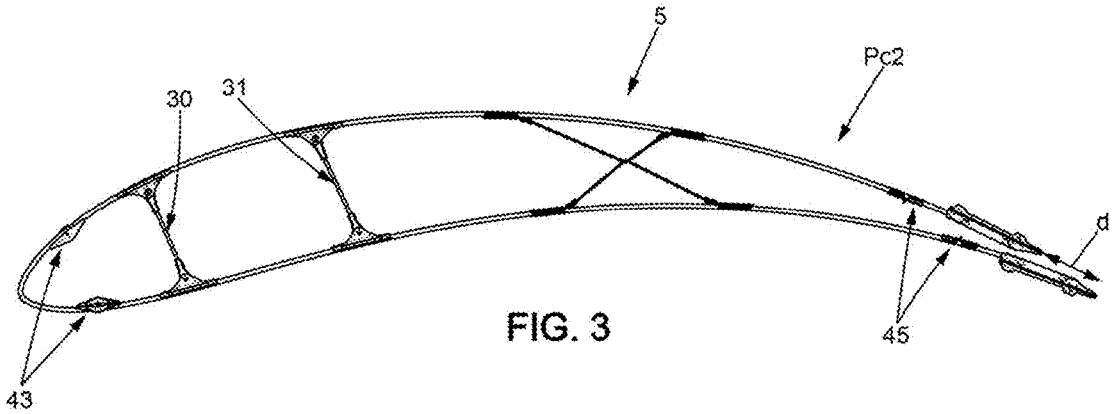
FIG. 3 is a view of the cambering device in a cambered position of the semi-rigid elastic structure under the action of actuating means (not illustrated).

1—. Cambering device,
10. Bottom cambering device,
11, 12, 13, 14. Intermediate cambering devices,
2 Semi-rigid structure
20, 21: First length section and second length section,
22. U-shaped connecting section
23, 34: Free ends,
3. Spacer system,
30, 31. First spacer and second spacer,
32. Connector,
4 Actuating means,
40, 41. Actuators, first and second;
42 External tendon(s)
43. Deflectors, in particular first deflector 431, and second deflector 432
44. Tendon, internal, flexible,
5. Flexible connection system
50. First flexible link,
51. Second flexible link,
6. Fastening means (sail),
7. Securing system (for blocking the cambering device on the mast),
71, 72, First strand and second strand,
8. Guides (tightening device)
9. Tightening link
AS. Plane of symmetry of the semi-rigid structure (FIG. 2)
B. Balloon (artificial muscle),
Ev Envelope (in particular braid),
BA. Leading edge
BF Trailing edge
V. Profiled sail d: offset between the two free ends ZC. Contact area between the two flexible links, m1, m2 Respectively, at least one actuating member, first and second actuating members and a common actuating member, Pr. Rest position, Pc1. First camber position, Pc2. Second camber position, L1, L2. Link and additional link, SV1, SV2, SV3, SV4, SV5. Profiled sail sections, Lh, Ih. Height dimensions (for the bottom cambering device and the intermediate cambering devices)

The invention claimed is:

1. An assembly, comprising: a profiled sail, a mast and several cambering devices for a profiled sail, the cambering devices comprising:

a semi-rigid structure, elastically deformable, including:

two length sections, extending in front of one another, respectively forming a first length section secured to a first surface of the profiled sail, and a second length section secured to a second surface of the profiled sail, a U-shaped connecting section, interconnecting the first length section and the second length section at the leading edge of the profiled sail while extending them, the two length sections terminating at the trailing edge of the sail by two free ends, and wherein the mast extends inside the semi-rigid structure, between the two length sections and wherein the profiled sail is configured to be:

hoisted along the mast, in a high position of the profiled sail, the cambering devices in positions separated from one another, sprawled along the mast in a low position of the profiled sail, the cambering devices in positions closer to one another than in the high position of the profiled sail, wherein said assembly comprises a system for reducing the surface area of the profiled sail exposed to the wind, configured to reduce the surface area of the profiled sail in an intermediate position along the mast between said high position of the profiled sail and said low position, comprising:

several distinct and separate sections of the profiled sail along the direction of the mast, made of flexible cloth, with at least a first section of the profiled sail and a second section of the profiled sail, the several cambering devices comprising several structural cambering devices, comprising a bottom structural cambering device and one or more intermediate cambering devices including a first intermediate structural cambering device, said one or more intermediate structural cambering devices ensuring the transmission of forces due to the pressure of the wind on the profiled sail between two successive separate and distinct sections of the profiled sail, with a lower edge of the first section of the profiled sail connected to an upper edge of the bottom structural cambering device, and an upper edge connected to a lower edge of the first intermediate structural cambering device, a lower edge of the second section of the profiled sail connected to the upper edge of the first intermediate cambering device, so that in the high position of the profiled sail, the tensioned cloth of the first section of the profiled sail and the tensioned cloth of the second section of the profiled sail extend discontinuously along the direction of the mast, the semi-rigid structure of said first intermediate structural cambering device, extending the first section of the profiled sail and the second section of the profiled sail in the high position of the profiled sail ensuring the transmission of the forces between the first section of the profiled sail and the second section of the profiled sail, a removable fastening system, ensuring connection between the structural cambering devices, at least between the bottom structural cambering device, and said first intermediate structural cambering device, and possibly connection between two successive intermediate structural cambering devices, when the profiled sail is in an intermediate position between said high position of the profiled sail and said low position of the profiled sail, the structural cambering devices in positions closer to one another than in the high position of the profiled sail, in all or part, with at least the bottom structural cambering device and the first intermediate structural cambering device closer to one another than in the high position of the profiled sail, said fastening system comprising hooking points projecting outside along the first length section and the second length section of the structural cambering devices, as well as a flexible link configured to hook on the hooking points of two successive structural cambering devices when the profiled sail is in said intermediate position with said two successive structural cambering devices approaching one another, while holding the section of the sail accumulated and connected to the two successive structural cambering devices, the cloth of the surplus accumulated first section of the sail being held by said link of the fastening system joining the semi-rigid structure of the bottom structural cambering device to the semi-rigid structure of the first intermediate structural cambering device and so that said link, and possibly an additional link joining the first intermediate structural cambering device and a second intermediate structural cambering device are configured so as to directly hook on the semi-rigid structures of the structural cambering devices, without creating any local tension on the sections of the profiled sail.

2. The assembly according to claim 1, wherein the hooking points consist of lugs or hooks projecting outwardly along the first length section and the second length section of the structural cambering devices.

3. The assembly according to claim 2, wherein the hooking points consist of hooks or lugs with enlarged ends.

4. The assembly according to claim 1, wherein said cambering devices comprise, in addition to the structural cambering devices of the system for reducing the surface area of the profiled sail exposed to the wind, secondary cambering devices, cooperating with different sections of the profiled sail, each in an intermediate position of the profiled section of the sail between the upper edge and the lower edge of said section of the profiled sail.

5. The assembly according to claim 4, wherein the semi-rigid structure of the structural cambering devices of the system for reducing the surface area of the profiled sail exposed to the wind, has a height dimension, along the direction of the mast, larger than a height dimension, along the direction of the mast, of the secondary cambering devices.

6. The assembly according to claim 1, wherein the number of distinct sections of the profiled sail is equal to the integer number N comprised between 2 and 10, such that N equals 5, and wherein the number of structural cambering devices of the system for reducing the surface area of the profiled sail exposed to the wind is equal to the integer number N.

7. The assembly according to claim 1, wherein the different sections of the profiled sail consist of cloths having different properties, in particular different materials and/or different basis weights.

8. The assembly according to claim 1, comprising actuating means interconnecting, on the one hand, the two free ends of the semi-rigid structure or at least one of the two free ends and, on the other hand, the U-shaped connecting section, configured to camber the first length section and the second length section of the semi-rigid structure by tensioning the two free ends with the U-shaped connecting section of the semi-rigid structure, or at least by tensioning one of the two free ends with the U-shaped connecting section of the semi-rigid structure, and the generation of an offset between the two free ends.

9. The assembly according to claim 8, wherein the actuating means configured to camber the first length section and the second length section of the semi-rigid structure comprise at least one actuator, having two longitudinal ends, said actuator able to be activated, being retractable when activated with its two longitudinal ends being brought close to one another, said at least one actuator extending along one of the two length sections of the semi-rigid structure, the first length section or the second length section, said actuator being inside the semi-rigid structure, contained in a plane of the semi-rigid structure, and wherein one of the longitudinal ends of said at least one actuator is connected to one of the two free ends by an internal tendon while the other one of the two longitudinal ends of said at least one actuator is connected either to an anchor point secured to the U-shaped connecting section, or to the other one of the two free ends via a deflector secured to the U-shaped connecting section by an external tendon, the flexible external tendon passing outside the semi-rigid structure, and the profiled sail between the deflector and respectively said other one of the two free ends.

10. The assembly according to claim 8, wherein the actuating means are configured to camber the semi-rigid structure selectively:

in a first cambered position in which said first length section has a concave profile when said second length section has a convex profile, in a second cambered position in which said second length section has a concave profile when said first length section has a convex profile.

11. The assembly according to claim 9, wherein said at least one actuator of the actuating means comprises:

a first actuator configured to camber the semi-rigid structure in said first cambered position, extending along the first length section, inside the semi-rigid structure, secured at one of its longitudinal ends to the external tendon, connected, on the one hand, to the free end of the first length section by said flexible external tendon, which is external to the semi-rigid structure, via a first deflector secured to the connecting section, U-shaped, the flexible external tendon passing outside the semi-rigid structure, and the profiled sail between the first deflector and respectively the free end of the first length section, the flexible external tendon being internal to the semi-rigid structure between the first deflector and said first actuator, the first actuator being secured at the other one of its longitudinal ends to the internal tendon, said first actuator connected; on the other hand; to the free end of said second length section by said internal tendon, which runs along the first length section up to a guide secured to said first length section before connecting said free end of said second length section, the first actuator being configured, in an active state, to retract and pull on the two free ends connected by the external tendon and the internal tendon, on the one hand, and on the first deflector, on the other hand, until creation of the offset, the end connected by the internal tendon advancing towards the leading edge relative to the free end connected by the external tendon while causing cambering of the semi-rigid structure, the loaded external tendon deviating from the first length section which takes on a concave profile, the second length section taking on a convex profile in said first cambered position, a second actuator configured to camber the semi-rigid structure in said second cambered position extending along the second length section inside the semi-rigid structure, secured at one of the longitudinal ends thereof to an external tendon, connected, on the one hand, to the free end of the second length section by the flexible external tendon which is outside the semi-rigid structure, via a second deflector secured to the U-shaped connecting section, the flexible external tendon passing on the outside of the semi-rigid structure and of the profiled sail between the second deflector and the free end of the second length section respectively, the flexible external tendon being inside the semi-rigid structure between the second deflector and said second actuator, the second actuator being secured at the other of the longitudinal ends thereof to the internal tendon, said second actuator connected, on the one hand, to the free end of said first length section by said internal tendon which runs along the second length section up to the guide secured to said second length section before connecting the free end of said first length section, the second actuator being configured, in an active state, to retract and pull on the two free ends connected to the external tendon and the internal tendon, on the one hand, and on the second deflector, on the other hand, until creation of an offset, the free end connected by the internal tendon advancing towards the leading edge with respect to the free end connected by the external tendon causing cambering of the semi-rigid structure, the loaded external tendon moving away from the second length section, which takes on a concave profile, while said first length section takes on a convex profile in said second cambered position.

12. The assembly according to claim 1, wherein all or part of the cambering devices have a securing system, able to be activated/deactivated, configured to ensure securing of the cambering device on the mast, the securing system comprising:

a first flexible strand linked to the first length section by two longitudinal ends of the first strand, the first strand circumventing the mast from the first length section, a second flexible strand linked to the second length section by two longitudinal ends of the second strand, the second strand circumventing the mast from the second length section, an actuator system, able to be activated, inside the structure configured to pass the first strand and the second strand into a retracted state to block the cambering device onto the mast, tightened between the first strand and the second strand, inside the semi-rigid structure, the mast held at a distance from the two length sections by the tensioned first strand and second strand, and up to a deployed state of the first strand and second strand to release the mast and enable the movement of the cambering device along the mast.

13. The assembly according to claim 12, wherein the actuator system of the securing system comprises at least one actuating element having two longitudinal ends, said actuating element, able to be activated, being retractable when activated with the two longitudinal ends brought close to one another.

14. The assembly according to claim 12, wherein the cambering devices comprise all or part of a spacer system comprising a first spacer interconnecting the first length section and the second length section as well as a second spacer, interconnecting the first length section and the second length section, parallel to said first spacer, on the one hand, and the second length section, on the other hand, and wherein the longitudinal ends of the first strand are secured at two attachment points on the first length section respectively at the junction areas between the first and second spacers and the first length section, the longitudinal ends of the second strand being secured at two attachment points on the second length section respectively at the junction areas between the first and second spacers, and wherein the mast extends between the spacers consisting of the first spacer and the second spacer, the first strand and the second strand tightened on the mast ensuring holding of the mast at a distance from the first spacer, on the one hand, and the second spacer, on the other hand.

15. The assembly according to claim 1, wherein the system for reducing the surface area of the profiled sail exposed to the wind includes a tightening device, configured to bring two structural cambering devices close to one another, in particular the bottom cambering device with the intermediate cambering device(s), or configured to bring two intermediate cambering devices close to one another, the tightening device comprising:

guides, such as castors, secured to the rigid structure of the two structural cambering devices to be brought close to one another, the guides arranged on an inner side of the semi-rigid structure, along the first length section and/or along the second length section at least one tightening link extending within the profiled sail, and which runs along the guides, while being guided by the guides, the guides arranged alternately on the two cambering devices along the pathway of the link, the link fastened at a distal end on the semi-rigid structure of one of the two cambering devices to be brought close to one another and so that the tightening device is configured so that a tension on the tightening link causes the two structural cambering devices to be brought close to one another.

16. A sailboat comprising an assembly according to claim 1.

17. A method for reducing the surface area of the profiled sail exposed to the wind from an assembly according to claim 1 from the high position of the profiled sail on the mast, the cambering devices in positions separated from one another, and wherein it is proceeded with the reduction of the surface area of the profiled sail exposed to the wind by:

partially sprawling the profiled sail into an intermediate position between said high position of the profiled sail and said low position, and by bringing at least the bottom structural cambering device and said first intermediate structural cambering device closer to one another than in the high position of the profiled sail, and possibly at least two successive intermediate cambering devices, the structural cambering devices in positions closer to one another than in the high position of the profiled sail, in all or part, placing the link of the fastening system between at least the bottom cambering device and the first intermediate cambering device brought close to one another, the cloth of the first section of the sail, accumulated and held at least by the link joining the semi-rigid structure of the bottom cambering device to the semi-rigid structure of the first intermediate cambering device, and possibly placing at least one additional link between the successive intermediate cambering devices, the intermediate link holding the section of the sail accumulated between said intermediate cambering devices.

* * * * *